United States Patent [19]

Sletten

[11] 4,298,877

[45] Nov. 3, 1981

[54] OFFSET-FED MULTI-BEAM TRACKING ANTENNA SYSTEM UTILIZING ESPECIALLY SHAPED REFLECTOR SURFACES

[75] Inventor: Carlyle J. Sletten, Acton, Mass.

[73] Assignee: Solar Energy Technology, Inc., Bedford, Mass.

[21] Appl. No.: 7,155

[22] Filed: Jan. 26, 1979

[51] Int. Cl.[3] ..... H01Q 19/14

[52] U.S. Cl. ..... 343/781 CA; 343/837

[58] Field of Search ..... 343/781 CA, 779, 837, 343/840, 781, 781 P

[56] References Cited

U.S. PATENT DOCUMENTS

| | | | |
|---|---|---|---|
| 3,332,083 | 7/1967 | Broussaud | 343/761 |
| 3,914,768 | 10/1975 | Ohm | 343/781 CA |
| 3,983,560 | 9/1976 | MacDougall | 343/781 CA |
| 4,062,018 | 12/1977 | Yokoi et al. | 343/781 CA |

FOREIGN PATENT DOCUMENTS

| | | | |
|---|---|---|---|
| 1541611 | 4/1969 | Fed. Rep. of Germany | 343/781 CA |

OTHER PUBLICATIONS

Wilkinson, E. J., "New Earth-Station Antenna Features Low Sidelobes," Communications News, Feb. 1978.

Lee, J. J. et al., "A Shaped Offset-Fed Dual-Reflector Antenna," IEEE Trans. AP vol. AP-27, No. 2, Mar. 1979.

FIG. 41b, p. 1492, Proc. IEEE, vol. 65, No. 10, Oct. 1977.

Sletten, C. J., "Subreflector and Main Reflector Shaping for Beam Tracking Offset Antennas", IEEE-AP-S Symposium, Seattle Wash. 6/79.

*Primary Examiner*—David K. Moore

[57] ABSTRACT

A reflector antenna system is described suitable for ground stations used in communication with geostationary satellites. Dual beams or multi-beams can be directed at several satellites spaced angularly from 5° to 20° apart and these beams are scanned by feed motion keeping a single main reflector surface fixed. Offset feed geometry is used for low aperture blocking and shaping of subreflectors and main reflector results in very high aperture efficiencies, low sidelobes and symmetric low cross-polarization patterns needed for satellite links. A novel method for shaping subreflectors using the ratios of ray lengths squared and variable focal lengths is applied in the optimally tilted offset geometry results in almost uniform aperture power distributions. A new general procedure for shaping doubly curved surfaces intercepting a known population of rays such that these rays are focused to a point or reflected in a given direction is used to shape the main reflector for elimination of aperture phase errors and to shape a second subreflector which focuses perfectly to the apex of a second feed horn.

21 Claims, 9 Drawing Figures

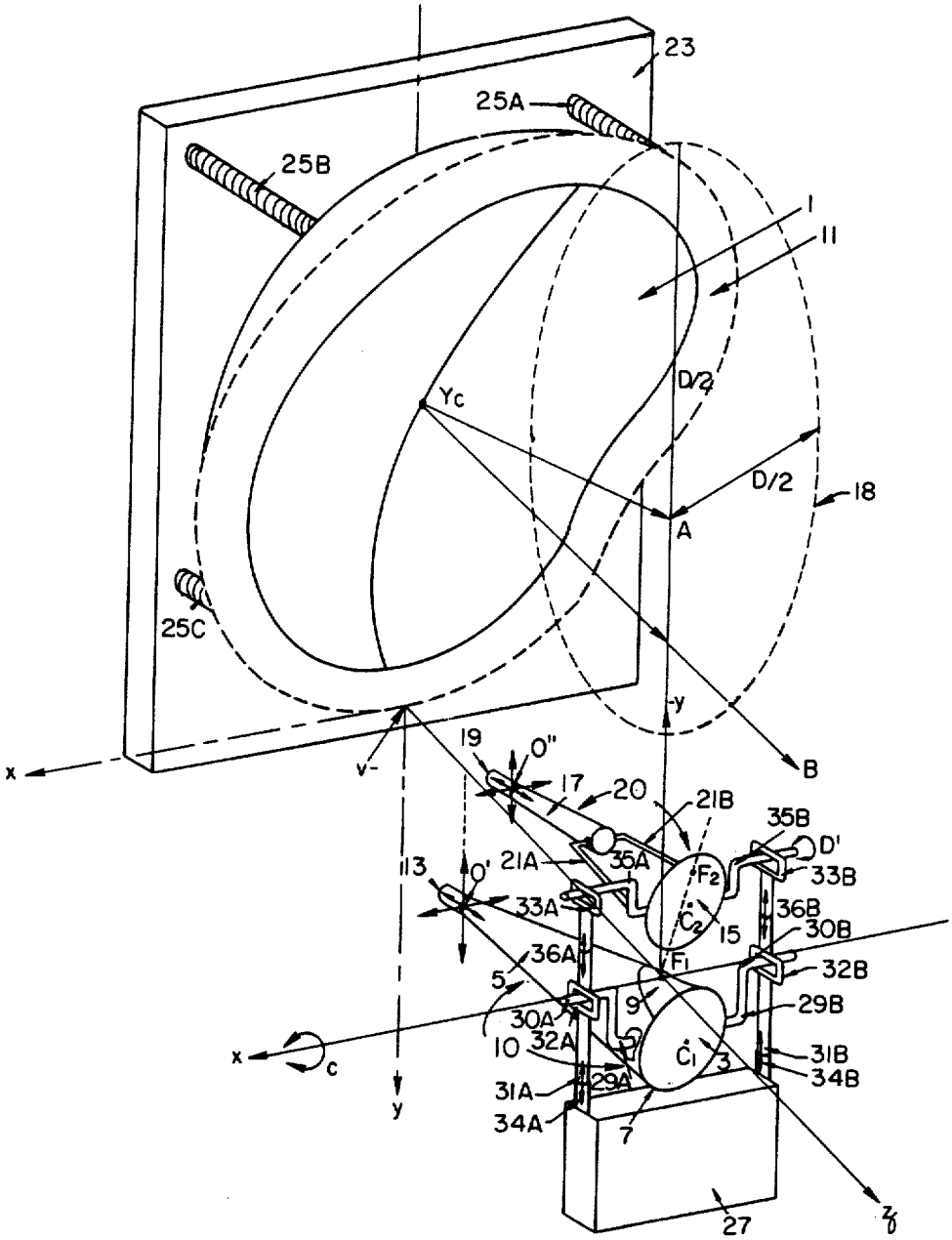
FIG. IA

OFFSET-FED MULTI-BEAM TRACKING ANTENNA SYSTEM UTILIZING ESPECIALLY SHAPED REFLECTOR SURFACES

BACKGROUND OF THE INVENTION

This invention relates to an antenna and more particularly to one operable for transmitting and receiving electromagnetic radiation at frequencies above 30 mHz using reflecting surfaces.

Communication antennas for ground stations used in links with satellites in geostationary orbits are required by the Federal Communications Commission and the International Radio Consultative Committee to have sidelobe levels outside an angle $\theta=1°$ cone about their main beams below the level of $$32-25\log_{10}\theta$$

in decibels referred to an isotropic radiator and an axial ratio for circular polarization that does not exceed 1.09. These stringent specifications for sidelobe levels and polarization purity are not met by many antennas currently installed. It is economically important that aperture efficiencies on large reflector antennas used in satellite communications be as high as possible in order to realize high antenna gains with smallest possible reflector areas.

Most present day ground station antennas for satellite links are reflector antennas fed by Cassegrain subreflectors and horns symmetrically located on the reflector axis such that subreflector and horn are directly in front of the main reflector (U.S. Pat. Nos. 4,044,361, 3,983,560, 3,995,275, 3,821,746, 3,562,753). This configuration of the reflector feed causes aperture blocking which, in turn, produces unwanted sidelobes generally in the direction of communication satellites located about 35,800 kilometers above the earth's surface in orbits about the earth's equator. These ground-based reflector antennas are generally mounted on a pedestal which moves the entire antenna in the direction of a satellite for tracking slight relative angular motions of the satellite which is emitting signals to, or receiving signals from, the antenna. Large reflector antennas mounted on a pedestal are subject to reflector surface deformation due to gravitational and wind loading. The struts in front of the reflector aperture used to support the horn and subreflector also cause increase in sidelobe levels. The in-line arrangement of horn, subreflector and main reflector causes specular reflections back to the horn which produces an unwanted increase in voltage standing wave ratios. Electromagnetic energy is lost due to spillover which means not all radiation from the horn separated from the subreflector strikes the subreflector, and not all radiation from the subreflector strikes the main reflector. When the subreflector surface is enlarged to give a sharper pattern gradient at the edge of the main reflector, the blocking sidelobes levels increase. Offset feeding (U.S. Pat. Nos. 3,914,768; 3,949,404; 3,810,187; 3,332,083; 3,500,427; 3,936,837; 3,792,480) has been used to improve the performance of antennas for radar and satellite communications. However, the aperture efficiency for prior art antennas has been low because no means was known for shaping the asymmetrically located subreflectors to produce the nearly uniform aperture illumination which is needed for high aperture efficiency. Antenna beam scanning by feed motion is known. (See U.S. Pat. Nos. 3,500,427; 3,914,768; 3,641,577; 3,745,582). However, no means for fully correcting optical aberrations, which cause aperture phase errors contributing to increased sidelobe levels and loss in antenna gain on offset fed reflectors, has been reported when the antenna beams are pointed away from the principal axis of the main reflector. Furthermore, no means is known for correcting optical aberrations on feed systems using shaped subreflectors and horns scanned or producing more than one beam by feed motion or displacement from a preferred orientation.

With reference to prior art, there are three patents which, although they relate to the objectives of the present invention, differ in fundamental aspects from the antenna system to be described. The invention of Bartlett and Sheppard, U.S. Pat. No. 3,737,909, improved the antenna aperture illumination efficiency by use of a dielectric refractive element. This technology is restricted to antennas with rotational symmetry about the main reflector axis and not applied to offset geometry. The method for design uses conventional integral relations between the feed power angular distributions and the angular power distribution transmitted through the refractive element as described by W. F. Williams in an article in the Microwave Journal in the July 1965 issue, pages 77 to 82. Karikomi and Kataoka, in U.S. Pat. No. 3,745,582, describe technology for steering radiated beams using a dual reflector antenna. Their graphically two-angle corrected reflectors require motion of the subreflector while keeping feed horn position fixed and the antenna is capable of steering beam angles only slightly spaced apart. No extension to offset geometry is described and aperture efficiencies are generally low and uncompensated for. In the Cassegranian antenna described by Ohm in U.S. Pat. No. 3,914,768, multiple antenna beams are formed with offset dual reflector antennas by use of a fixed main paraboloidal reflector and a hyperboloidal subreflector illuminated by a plurality of feed horns displaced transverse to the right-left symmetry plane of the antenna. In this description no means are given for scanning by feed motions, for correcting optical aberrations resulting from feed horn displacement from the focus of the hyperboloidal subreflector, nor are means suggested for improving antenna aperture efficiency, nor for reducing spillover losses.

SUMMARY OF THE INVENTION

It is an object of this invention to increase the aperture efficiency of reflector antennas fed by offset subreflectors and horns by shaping the reflecting surfaces of the subreflector and main reflector. Throughout this description shaping of reflectors or subreflectors means changing the reflecting surface from that of a conic section surface such as a parabola, paraboloid, ellipse, ellipsoid, hyperbola or hyperboloid.

Another object of this invention is to eliminate the pedestal generally used for supporting the main reflector antenna and its feed systems and for tracking the changes in directions of satellites, and to replace the pedestal by a simpler fixed support for the main reflector and a method for tracking satellites by feed motion only.

Still another object of this invention is to provide two or more beams for communicating simultaneously with two or more satellites located at different angles relative to the antenna with a single fixed mounted main reflector.

Yet another object of this invention is to decrease subreflector spillover losses and antenna pattern sidelobes by the connecting horn radiator and subreflector of the offset fed system such that radiation is restricted to an orifice near the focal region of the main reflector.

An important object of this invention is to obtain the offset subreflectors and main reflector shapes in convenient rectangular cuts for easy construction, and for locating and orienting the antenna portions such that symmetric, low crosspolarized beams needed for circular polarization are produced with high antenna aperture efficiencies and very low sidelobes.

A further object of this invention is to shape reflector antennas for various shaped antenna patterns focused to designated positions.

Yet another object of this invention is sidelobe control by controlling the illumination taper at edge of the main reflector aperture to reduce spillover and edge diffraction sidelobes and, at the same time, maintain high aperture efficiency.

A still further object of this invention is to scan multiple antenna beams which have low sidelobes, low crosspolarization and high gain by positioning moveable feed horns with respect to fixedly located subreflectors and main reflectors such that the focal surfaces of the horn-subreflector feeds are similar in form to the focal surfaces of the main reflector.

To obtain still further improvements in antenna pattern performance, it is another object of this invention to so position and move feed horns with respect to independently positioned moveable subreflectors in order to better illuminate a fixedly located main reflector while scanning multiple beams.

Another object of this invention is to locate the feed systems for generating two or more independently scanned beams such that mechanical and electromagnetic interaction is very low. One preferred beam has virtually no blocking and the focal region of the main reflector is unobstructed.

A further objective of this invention is to correct the optical aberrations for beams generated off the axis direction of the main reflector such that waves impinging from directions remote from the on-axis direction are well focused to a point where the center of phase of a feeding horn can be located, these corrections being found for shaped surfaces needed to increase antenna aperture efficiency.

Several of the unique characteristics and advantages of the antenna system herein described are summarized in relation to prior art in offset reflector antennas.

One of the antenna's two subreflectors is shaped using a new construction (for controlling the power density distribution on the main reflector aperture) based on the feed horn's power pattern which regulates the ratios of ray path lengths squared connecting the horn, subreflector and main reflector. The shape of the subreflector surface does not have rotational symmetry and the doubly curved surface cannot be obtained by simply rotating a line curve about an axis as is done for symmetrical Cassegrain antennas. However, offset reflector antenna systems usually do have right-left symmetry making it necessary to locate only ½ the subreflector and main reflector points because points on opposite portions can be constructed using this right-left symmetry. The antenna system of this invention employing the point-by-point ray ratio construction of subreflector and main reflector can achieve very high antenna aperture efficiencies not attainable by other offset fed reflector antennas.

The main reflector surface and the subreflector surfaces of this invention are located and shaped such that they are proximate to and tangent to at points near their centers, reference surfaces which are especially chosen sections of paraboloids, ellipsoids and hyperboloids. These reference surfaces are selected such that circular antenna beam symmetry and very low crosspolarization are guaranteed. Due to their likeness and proximity to these reference shapes the non-conic section shapes employed in this invention have symmetric beams and low crosspolarization which characteristics are seldom attained with offset reflector antennas.

In order to achieve extremely good control of sidelobe levels and antenna patterns, the doubly curved main reflector surface is shaped to correct for phase errors caused by the subreflector shaping and spill-over sidelobes are reduced by making the subreflector area large which produces sharp dropoff of power beyond the main reflector area and by positioning the feed horn aperture near to the subreflector or actually connecting the horn aperture to the subreflector edge. Concaved subreflectors similar in form to ellipsoids are used to permit the feed horn to be attached or nearly touch the subreflector. Spill-over radiation escaping around the subreflector is a major cause of antenna sidelobes which enter the geostationary satellite orbits from Cassegrain antennas currently in use for satellite communications.

The antenna system can produce a single excellent pattern and beam or produce multiple antenna beams which can be tracked or scanned using feed motions while maintaining the main reflector in a fixed position. For multi-beam scanning, two or more feed horns are positioned more or less in the right-left plane of symmetry which plane divides the shaped subreflectors and main reflector into nearly equal portions. The horns and subreflectors are positioned such that the shape of the focal field or caustics of the subreflectors fed by the horns are similar to the focal or caustic fields of the main reflector when illuminated by a plane wave coming from the beam direction scanned or tracked.

By using a concaved shaped first subreflector, the focal region of the main reflector is unobstructed—so that a second subreflector can be positioned behind the main reflector focus. This second subreflector is especially shaped to focus the energy incident on the shaped main reflector from a second beam direction to the phase center of a second horn feed. By matching focal fields this second beam can be scanned and also additional horns can illuminate the second subreflector to produce additional scanned beams.

Other objects and advantages of the invention will become apparent upon consideration of the present disclosure in its entirety.

BRIEF DESCRIPTION OF THE DRAWINGS

FIG. 1A is a perspective view of a dual-beam, offset-fed, shaped reflector antenna designed in accordance with the present invention.

DETAILED DESCRIPTION OF THE PREFERRED EMBODIMENTS

Figure 1B:
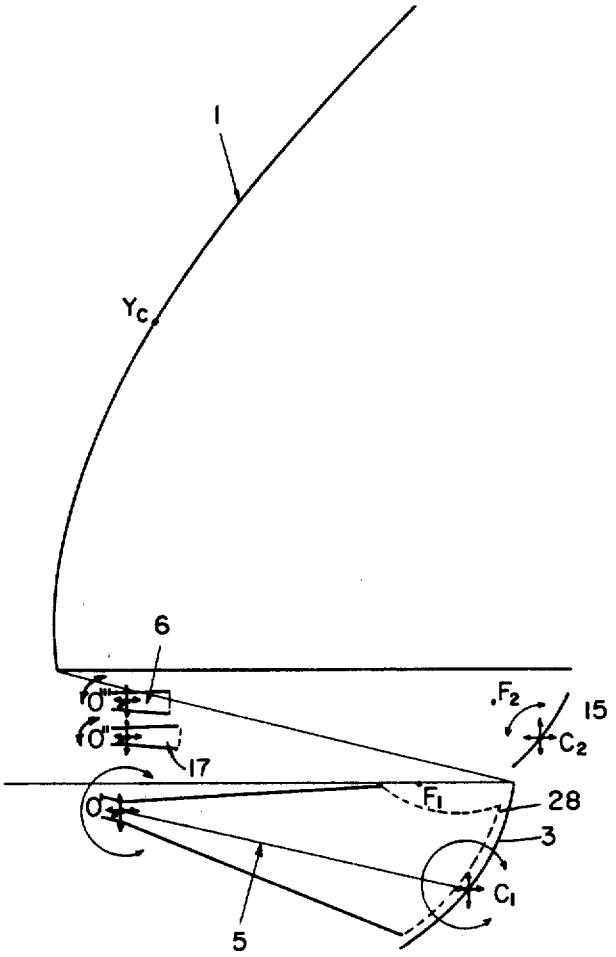
FIG. 1B is a cross-sectional view showing details of feed motion for scanning multiple antenna beams.

Referring now to the drawings, wherein like referenced numerals or letters designate identical or corresponding parts throughout the several views and more particularly to FIG. 1A where is illustrated a perspective view of the reflectors, subreflectors, horns, supports, and other members comprising an antenna for communicating with two satellite borne transponders located in or near geostationary orbit in directions from the antenna indicated by arrows A and B. The main reflector surface 1 is non-paraboloidal in shape and serves to reflect electromagnetic energy from the principal shaped subreflector 3 which is illuminated by the conically formed horn 5 which is attached to the principal subreflector 3 at the edges 7 of the shaped subreflector 3. A cut away portion of the conical horn wall opens an orifice 9 providing space for electromagnetic waves to emerge or enter and pass through a region in the neighborhood of $F_1$. $F_1$ is the origin of a rectangular coordinate system x, y, z oriented as shown in FIG. 1. $F_1$ is also the geometric focus of a reference paraboloid 11 which, although shown by dotted line in FIG. 1, is not physically present and serves only to describe the method for constructing the shaped surfaces of the actual reflector 1, subreflector 3, and other portions of the antenna. At 13 a waveguide port is shown which transports electromagnetic energy to and from transmitters, orthomode transducers and receivers or other attached equipments to the horn 5 which serves with antenna portions 3 and 1 to generate a beam in approximately the direction indicated by arrow A parallel to the z axis. The edge of the main reflector surface 1, when projected on the aperture plane, is nearly a circle 18 of radius D/2 and the electromagnetic power fed to the waveguide at port 13 is distributed over the reflector surface 1 and of the approximately circular aperture, 18, almost uniformly such that the antenna gain is nearly maximum for the aperture of radius D/2 at the electromagnetic frequency or frequencies used.

Shown also in FIG. 1A is a second shaped subreflector 15 illuminated by a second conical horn 17 which is fed by waveguide port 19. Horn 17 is mechanically attached to subreflector 15 by portions 21A and 21B which are widely separated to allow electromagnetic energy passing through regions surrounding points $F_1$ and $F_2$ to be unobstructed. Horn 17 and subreflector 15 together operate when fed at port 19 to generate receiving and transmitting antenna patterns with their main beam approximately in the direction of arrow B and to illuminate the main reflector surface 1 nearly uniformly. Portions 15, 17 and 19 produce, when operating with the principal feed portions 3, 5 and 13, simultaneously and separately two antenna patterns.

The main reflecting surface 1 is supported by and mounted to structure 23 which is generally mounted onto the earth's surface. Although reflector 1 is not moved for tracking angular variations in satellite or other electromagnetic source directions, adjustment devices 25A, 25B, and 25C, or other means, are provided for initial orientation and adjustment of the main reflector surface 1 and to accomodate slow long-term drift of satellite angular positions.

The dual beams generated by the principal feed system 10 including portions 3, 5, 9 and 13, and the second feed system 20 including portions 15, 17, 19, 21, are scanned through small solid angles about the nominal position of two radiation sources by independent motions. A typical structure for supporting and positioning feed systems 10 and 20 are shown in FIG. 1A. Many similar mechanical means for supporting and moving these feeds are possible and are contemplated as being within the scope of this invention.

Referring to the principal feed system 10, the scanning of the antenna beam about the direction indicated by arrow A can be accomplished by rotating and translating the horn 5 fixedly attached to subreflector 3 at 7 along with feed port 13 and orifice 9 with respect to point $F_1$. Support member 27 which is fixed in position in relation to reflector 1 is provided with arms 31A and 31B which can be extended or contracted in length by use of portions 34A and 34B on to which is attached a slot 32A and 32B into which circular rods 30A and 30B lying nearly along the x axis are free to move about point $F_1$ and also to rotate as shown by curved arrow C. Rods 30A and 30B are connected by means of bent members 29A and 29B to the exterior wall of horn 5. When the axis of the principal feed system which is the line connecting O', the center of phase of horn 5, with $C_1$ the center of shaped subreflector 3 is positioned about the point $F_1$, there is corresponding motion of the horn and subreflector indicated by arrows at 0' causing predictable changes in beam direction about the direction of arrow A.

Likewise, the second feed system 20 is moved about the point $F_2$ by means of fixed support 27 attached to slots 33A and 33B which receive rods 35A and 35B, the location of 33A and 33B above 27 being adjustable by members 36A and 36B. Rods 35A and 35B are firmly attached to subreflector 15. The linear and rotational motion of rods 35A and 35B in slots 33A and 33B, and of the slots 33A and 33B in sliding members 36A and 36B, permit the motion of the second feed system 20 about point $F_2$. The associated motion of the feed axis which connects 0'', the center of phase of horn 17, to $C_2$, the center of subreflector 15, provides the motion indicated by arrows shown about point 0'' and waveguide port 19 which rotations and motions of feed system 20 cause a predictable scanning of the second antenna beam about direction indicated by arrow B.

Because the angular positions of geostationary satellites do not vary more than about ½ degree per year, small tracking motions provided by the typical apparatus for moving the feed systems 10 and 20, as shown in FIG. 1A, are usually sufficient to continuously direct beams pointed approximately in directions indicated by arrows A and B at their respective satellites without sensible interactions caused by feed members or their supports upon the dual antenna patterns. The feed systems 10 and 20 can be adjusted for very low sidelobes, low crosspolarization, maximum gain or other desired characteristics using adjustments described herein and then fixed in these positions to receive or transmit signal to or from stationary locations.

In FIG. 1B a cross-sectional view of the antenna taken through the y-z plane shows positions and motions of portions of the feed systems for scanning antenna beams over larger angular intervals than is possible with the antenna as shown in FIG. 1A.

Scanning of the antenna beams can be achieved by maintaining subreflectors 3 and 15 fixed with respect to fixed main reflector 1 and support 27 and by translating and rotating the horns only about the focal points $F_1$ and $F_2$. In this case horn 5 must be physically separated from subreflector 3 and likewise horn 17 must be separated from subreflector 15. Spill-over losses are increased when only the horns are positioned to effect scanning due to some electromagnetic energy missing the subreflectors. Such spill-over energy can be minimized by making the gap 28 between the horn mouth and the edge of subreflector 3 very small. Also, the area of subreflector 3 can be enlarged by extending the edges of the subreflector beyond the intersecting curve 7 shown in FIG. 1A for the case where the horn 5 and subreflector 3 were joined. Now subreflector 3 separated from horn 5 by a gap 28 can be fixed in position by attachment to support 27 and scanning about the direction A achieved by translational and rotational motion of the horn 5 as indicated by the arrows about the horn center of phase 0'. Likewise, subreflector 15 can be separated from members 21A and 21B shown in FIG. 1A and fixed in position by attachment to support 27 and scanning about the direction B realized by the rotational and translational motions of the horn 17 as shown by arrows near to the center of phase of horn 17, 0''.

The reason why larger angular intervals can be scanned about the directions A and B when subreflectors 3 and 15 are fixed in position and horns 5 and 17 only are changed in positions is the following. When horn 5 and subreflector 3, for example, are moved as a single rigid unit, its focal or caustic fields in the vicinity of $F_1$ have an unchanged form or structure. Although motion of this caustic structure about $F_1$ scans the beam about the direction A, the form of the caustic cannot easily be altered without changing the relative position of the horn with respect to the subreflector. When plane waves are incident upon the main reflector 1 from directions remote from the direction A the caustic focal field produced by reflection of the incident plane wave in the vicinity of $F_1$ is changed in structure in comparison with the main reflector caustic for a plane wave incident from direction A. By positioning the horn 5 with respect to subreflector 3 it is possible to change the structure of the feed system 10 caustic to approximate the form of the caustic of the main reflector for beam directions remote from the direction A. When this caustic matching condition is realized, antenna patterns with low sidelobes and high gain are obtained. Antenna patterns can be improved still further by independent positioning and motion of both the horns and subreflectors as shown by arrows surrounding 0', 0'', 0''', $C_1$ and $C_2$ of FIG. 1B. A third feed horn 6, as shown in FIG. 1B, can be positioned such as to match caustic structures with a plane wave arriving from a third direction remote from either direction A or B to produce yet another scanned antenna beam. Although still more beams can be produced by adding additional horns or additional subreflectors available space and pattern performance requirements limit the number of antenna beams.

Figure 2:
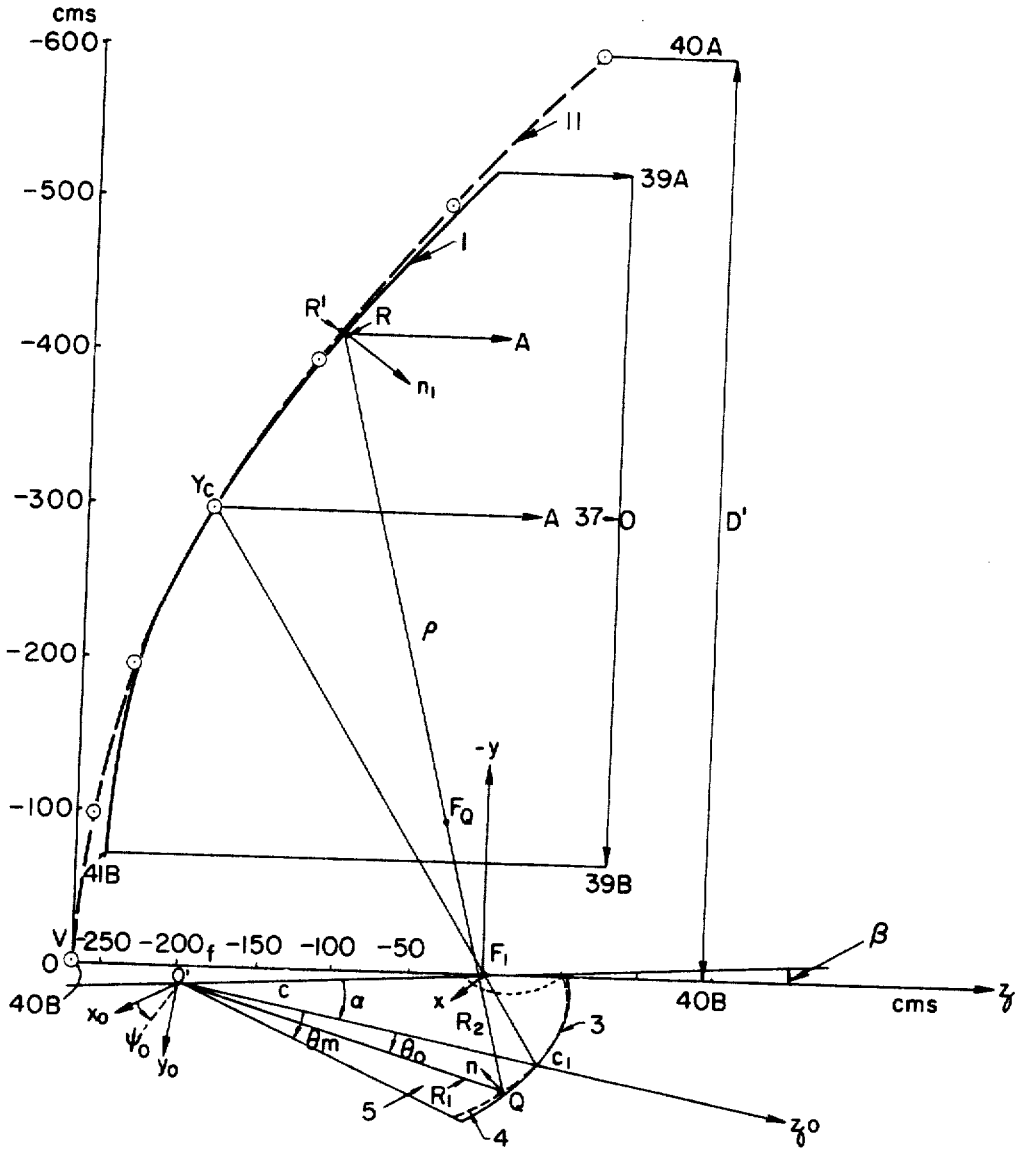
FIG. 2 is a cross-sectional view of the antenna showing the principal horn, shaped subreflector and shaped main reflector.

To illustrate how subreflector 3 is shaped to control the power distribution on the aperture of the main reflector 1, refer now to FIG. 2 where is shown a cross-section through the yz-plane of a pattern of the antenna shown in FIG. 1A. A cut through the main reflector 1 locates the mid-point $Y_c$ of the surfaces 1 and 11 and shows directly behind the main reflector surface 1 the reference section of paraboloid 11 which, if constructed, would focus to point $F_1$ which is the origin of coordinates x, y and z as shown. For purposes of illustrating the method of construction, but by no means restricting the antenna to these dimensions, numerical values of parameters will be given as typical. For example, the focal length, f, which is the distance between the vertex point lebeled V and the focal point, $F_1$, can be 270 cms. The distance vertically measured along the negative y axis (to $Y_c$) can be 300 cms. Shown also in FIG. 2 is an yz-plane cross-section through feed system 10 showing the shaped subreflector 3 and the electromagnetic horn 5 which, for the purpose of this example, has a flare angle, $\theta_M$, of 13.64° measured from the axis $0'C_1$ of the horn to the edge of the subreflector 3. The distance along the straight line c from 0' to $F_1$ is here assumed to be 200 cms. At 0', for purposes of explaining the method, we erect a rectangular coordinate system with $z_o$ pointed along $0'C_1$ as shown, $x_o$ parallel to x which is directed out of the paper and $y_o$ perpendicular to both $z_o$ and $x_o$ directions as shown in FIG. 2. Furthermore, it is useful to define spherical coordinates, $R_1=r$, $\theta_o$, $\phi_o$ as shown in FIG. 2 at 0'.

At radio frequencies used in satellite communications ray optics can be used to accurately derive the form of a reflecting surface 4 herein called the subreflector references surface which, if constructed, would reflect rays originating at 0' through the point $F_1$ such that all rays passing through $F_1$ will be reflected from the main reference surface 11 in the direction indicated by the arrow A. The references subreflector surface 4 would then be a conic section in the form of an ellipsoid of eccentricity e=0.65 for the example corresponding to numerical parameters previously mentioned.

When the reference main reflector 11, as shown in FIG. 1A, is an offset section of a paraboloid of focal length f, with vertex at V and center at x=O, $y=Y_c$, and having a circular aperture of diameter D, then the angle $\beta$ can be found from equation (1A)

$$|Y_c| = \frac{4fe\sin\beta}{1+e^2-2e\cos\beta} \qquad 1A$$

where e is the eccentricity of the reference ellipsoidal or hyperboloidal subreflector surface.

The angle $\alpha$ can be found from equation (1B)

$$\tan\alpha = \frac{(1-e^2)\sin\beta}{(1+e^2)\cos\beta-2e} \qquad 1B$$

and the dimensions of the reference ellipsoidal or hyperboloidal surfaces can be calculated from equation (1C)

$$R_1 = \frac{ed}{1-e\cos\alpha\cos\theta_o+e\sin\alpha\sin\theta_o\cos\phi_o} \qquad 1C$$

where $R_1$ is the distance from the phase center of the horn 5 to a point on the references conic section 4, and d is a constant.

Equations (1A), (1B), and (1C) can be obtained or derived from analysis found in article by Y. Mizugutch and H. Yokoi entitled "On Surface of Offset Type Dual Reflector Antenna" (Japanese), Transactions IECE 1975/2 Vol. 58-B No. 2, pages 94 and 95, and in article by H. Tanaka and M. Mizusawa entitled "Elimination of Cross Polarization in Offset Dual-Reflector Antennas," (Japanese), Transactions IECE 1975, Vol. 58-B No. 12, pages 643 to 650.

In the antenna system described herein the reflector surfaces described in the above two articles are not the reflector surfaces constructed. When possible and desirable, however, reflector surfaces of the present invention are constructed near to the references surfaces in order to obtain to some degree the circular beam symmetry and the elimination of crosspolarization theoretically achieveable from the references surfaces. Surfaces approximating the ellipsoidal forms of the references surfaces have two advantages which are the reduction of spill-over about the subreflector edges because the feed horn can be attached to or located near the subreflector, and that two or more subreflectors can be located near the focal region of the main reflector.

If horn 5 with phase center at 0' illuminates the references subreflector 4 uniformly, then the power density on the main reference reflector 11 would be slightly stronger at the center 37 of the main reflector aperture D' than at the edges 40A and 40B. However, all horns have large tapers that is the illumination power decreases as the cone angle $\theta_o$ increases toward the flare angle $\theta_M$ shown in FIG. 2. A −10 db taper at the flare angle $\theta_M$ is typical corresponding approximately to a typical horn pattern given by the equation $$G(\theta_o)=\cos^{80}\theta_o \tag{1D}$$

when $\theta_o$ equals the flare angle $\theta_M=13.64°$ at its maximum value.

Such tapered horn illumination produces a strongly tapered amplituded power distribution on the aperture D' and results in loss in gain and aperture efficiency. An object of this invention, therefore, is to shape subreflector surface 3 such that the tapered electromagnetic power of horn 5 is distributed uniformly across the aperture D of the shaped main reflector 1 which is also especially shaped to reflect the rays from subreflector 3 so that all these reflected rays are parallel to the direction indicated by the arrow A.

When $\beta$ the angle between a line c drawn from 0' through $F_1$ and the z axis is, for the example chosen, $\beta=3.046°$ and the axis of the horn is depressed in angle from the line $0'F_1$ by an angle $\alpha=14.29°$ then when the conical horn 5 has a pattern with no variations in the angle $\phi_o$ and with a symmetrical pattern in $\theta_o$ corresponding to equation 1D, then rays reflected from reference subreflector surface 4 will pass approximately through $F_1$ and produce an aperture amplitude distribution over the surface 11 which is circularly symmetric about the point $Y_c$ producing a pattern with main beam in the direction A with E-Plane and H-Plane cuts through this pattern approximately equal and free from cross polarized components caused by reflectors 4 and 11. However, when the horn taper is high the aperture efficiency of this reference antenna will be low.

To determine the shapes of subreflector 3 and main reflector 1 such that the amplitude distribution of power across the aperture D is nearly uniform and that all reflected rays from main reflector surface 1 emerge parallel to the direction A, which direction is also parallel to the z axis direction, we commence by fixing points $Y_c$, $C_1$, $F_1$, and O' and the tilt angles, $\alpha$ and $\beta$, as shown in FIG. 2. The aperture power density at any point P (x,y) on the surface 1 is either proportional to or inversely proportional to ray lengths $r_1=R_1$, $r_2=R_2$, and $\rho$ squared and more particularly the equation relating ray lengths to aperture power density over the surface 1 is:

$$\text{aperture power density} = P(x,y) = \frac{k_o r_2^2\, G(\theta_o,\phi_o)}{r_1^2\rho^2} \tag{2}$$

where $k_o$ constant is selected such that $P(x,y)=1$ at the point $Y_c$ on the reflecting surface 1, and $G(\theta_o, \phi_o)$ is a typical horn radiation pattern.

The coordinates x and y on reflecting surface 11 are related to the spherical coordinates $\theta_o$ and $\phi_o$ by the equations:

$$x = -B\tan\frac{\theta_o}{2}\cos\phi_o$$

$$y = Y_c - B\tan\frac{\theta_o}{2}\sin\phi_o$$

$$B = \frac{2f(1-e^2)}{1+e^2-2e\cos\beta}$$

and e is eccentrically of ellipsoidal surface 4 and f is focal length of paraboloid surface 11.

Equation (2) is a consequence of the fact that electromagnetic power flows along ray $r_1=R_1$ from O' to a point on subreflector 3 as a diverging spherical wave with power density decreasing proportional to the length of ray $r_1$ squared. Electromagnetic power associated with ray $r_2=R_2$ converges from point Q to a focal point $F_Q$ and therefore power density increases along the ray $r_2$ between points Q and $F_Q$ proportional to the square of the path length $r_2$. Similarly, power density flow associated with the ray $\rho$ decreases with the square of the path length $\rho$. To produce uniform power density over the surface we can set $P(x,y)=1$ in equation 2 everywhere over the surface 1. Alternatively, we can also make P(x,y) drop off rapidly near the edges of the surface 1 to improve the antenna pattern sidelobe performance. Also, for some applications, P(x,y) can be made highly tapered to produce extremely low sidelobes at the cost of low aperture efficiency. In the example herein presented P(x,y) will be set equal to 1 for uniform aperture power density distribution on the surface 1 in order to obtain maximum aperture efficiency and maximum antenna gain.

To construct surface 3 to produce uniform power density over the surface 1, for example, we must establish the location of all points Q on surface 3 such that equation (2) is satisfied and that a small area about Q reflects the incident rays $r_1$ in the direction of $r_2$ to point $F_Q$. To determine the surface 3 we write equations for the lengths and directions of rays $r_1$, $r_2$, and $\rho$, and for the location of the point $F_Q$ corresponding to a point on the shaped subreflector surface 3 using coordinates as shown in FIG. 2.

We can express the ray length $r_1$ as $$r_1=(x_o^2+y_o^2+z_o^2)^{\frac{1}{2}} \tag{3}$$

and the $r_1$ ray direction expressed as a unit vector is $$\hat{r}_1 = \frac{x_o}{r_1}\hat{x}_o + \frac{y_o}{r_1}\hat{y}_o + \frac{z_o}{r_1}\hat{z}_o = a_1\hat{x}_o + b_1\hat{y}_o + c_1\hat{z}_o \quad (4)$$

where $x_o$, $y_o$, $z_o$ are coordinates of the point Q and $\hat{x}_o$ is a unit vector directed along the $x_o$-axis, $\hat{y}_o$ is a unit vector directed along the $y_o$-axis, and $\hat{z}_o$ is a unit vector directed along the $z_o$-axis.

$a_1$, $b_1$, $c_1$, are the direction cosines of $\hat{r}_1$.

Likewise for $r_2$ the ray length is given by $$r_2 = [x_f - x_o)^2 + (y_f - y_o)^2 + (z_f - Z_o)^2]^{\frac{1}{2}} \quad (5)$$

and the $r_2$ ray direction $$\hat{r}_2 = \frac{(x_F - x_o)\hat{x}_o}{r_2} + \frac{(y_F - y_o)\hat{y}_o}{r_2} + \frac{(z_F - z_o)\hat{z}_o}{r_2} \quad (6A)$$

$$\hat{r}_2 = a_2\hat{x}_o + b_2\hat{y}_o + C_2\hat{Z}_o \quad (6B)$$

where $x_F$, $y_F$, and $z_F$ are the coordinates of the focal point $F_Q$; and $a_2$, $b_2$, $c_2$ are direction cosines of the unit vector $r_2$.

Also the ray represented by equation 6B can be expressed as equation of a straight line connecting point Q and $F_Q$, as:

$$x_o = \frac{a_2}{c_2} z_o + l \quad (7A)$$

$$y_o = \frac{b_2}{c_2} z_o + m \quad (7B)$$

where $a_2$, $b_2$, and $c_2$ from equation 6B are direction cosines of the line and l and m are constants of the line passing through the point Q.

To find the length of the ray $\rho$, we write $$\rho = L - r_2 \quad (8)$$

where L is the distance between points Q and R.

To find the length L, we note the surface 1 is in close proximity to the surface 11 and that, for example, the point R is located close to the point R' on the reference surface 11 which is the paraboloid surface with coordinates x, y, z given by $$x^2 + y^2 = 4f^2 + 4fz \quad (9A)$$

By solving equations 7A and 7B simultaneously with equation 9A, we can find where rays reflected at point Q passing through $F_Q$ intersect the surface 11.

These intersection points on surface 11 can be determined and identified as $x_{R'}$, $y_{R'}$, $z_{R'}$, and the distance from Q to R' is $$L = [(x_{R'} - x_o)^2 + (y_{R'} - y_o)^2 (z_{R'} - z_o)^2]^{\frac{1}{2}} \quad (9B)$$

It is necessary to transform the coordinates x, y, z of reference surface 11 to corresponding $x_o$, $y_o$, $z_o$ values using equations $$x = x_o$$

$$y = y_o \cos\gamma + z_o \sin\gamma + c \sin\beta$$

$$z = -y_o \sin\gamma + z_o \cos\gamma - c \cos\beta \quad (10)$$

where $\gamma = \alpha - \beta$ and c is the distance from 0' to $F_1$ chosen as 200 cms in the example used for illustration of the shaped reflector synthesis method.

Having found equations for path lengths $r_1$, $r_2$, and $\rho$, we use equations 1C and 2 to ascertain the locations of points Q and $F_Q$ together with the Snell's law for reflecting surfaces which expressed in unit vectors is:

$$\hat{r}_2 = \hat{r}_1 - 2(r \cdot n)n \quad (11)$$

where $\hat{n}$ is a unit vector normal to the shaped subreflector surface 3 at Q. Using equations (4) and (5) we can solve equation (11) for the components $a_n$, $b_n$, $c_n$, of the normal n which is $$\hat{n} = a_n\hat{x}_o + b_n\hat{y}_o + c_n\hat{z}_o \quad (12)$$

This normal vector provides information for moving from a Q point which can be labeled the $i^{th}$ point to a new point i+1 provided we use information about the location and normals obtained from earlier points in our construction of surface 3. The surface synthesis procedure, then, is iterative based on the location of and normals to earlier points. To make $X_o$ cuts on surface 3 parallel to the $x_o$-axis holding $y_o$ constant, we use the relation $$\frac{\partial z_o}{\partial x_o} = -\frac{a_n}{c_n} \quad (13)$$

Similarly, for making $y_o$ cuts parallel to the $y_o$-axis, holding $x_o$ constant, we use the relation $$\frac{\partial z_o}{\partial y_o} = -\frac{b_n}{c_n} \quad (14)$$

The procedure, then, for determining the coordinates $x_o$, $y_o$, $z_o$, on shaped subreflector surface 3 is to begin in the region near the known midpoint $C_1$ of subreflector 3 and reference subreflector 4, where the normal is also known and proceed to a new point, for example, letting $y_o$ be a constant for $x_o$ cuts and moving a small distance $\Delta x_o$ from $C_1$.

We determine the location of the new point, i+1, using the equations, for example, $$z_{oi+1} = z_{oi} + \frac{3}{2}\Delta x_o \frac{\partial z_o}{\partial x_o}\bigg|_i - \frac{1}{2}\Delta x_o \frac{\partial z_o}{\partial x_o}\bigg|_{i-1} \quad (15A)$$

$$x_{oi=1} + x_{oi} + \Delta x_o \quad (15B)$$

$$y_{oi+1} = y_{oi} \quad (15C)$$

Where the $i^{th}$ point is $C_1$ and the i−1 point is located at a distance, $-\Delta x_o$ from $C_1$, and the value of the partial derivative $$\text{at } \frac{\partial z_o}{\partial x_o}\bigg|_{i-1}$$

is obtained from the reference surface 4 or some other initial calculation.

Having projected to a new point, $Q_{i+1}$, it is necessary to again find the ratios of the rays squared according to equation (2) where now the horn illumination function $G(\theta_o)$ from equation (10) at the point $Q_{i+1}$ has changed. We can find the new value of $\theta_o$ at which the ray $r_1$ strikes the surface 3 using equations $$\tan \phi_{oi+1} = \frac{y_{oi+1}}{x_{oi+1}} \tag{16}$$

$$\tan \theta_{oi+1} = \frac{x_{oi+1}}{z_{oi+1} \cos\phi_{oi+1}}$$

with $r_{i+1}$ and $\theta_{o\,i+1}$ determined, we write using equation (2):

$$g = \frac{r_2}{\rho} = \frac{r_1}{k_o^{\frac{1}{2}} \cos^{n/2} \theta_{oi+1}} \tag{17}$$

Where $n/2=40$ in this example calculation and g is a parameter fixed by equation 17. Using equation (8) we obtain:

$$r_{2i+1} = \frac{gL}{1+g} \tag{18}$$

which gives us the length of the $r_2$ vector. Using the previous focal point location for $r_2$ direction in equation 6 we proceed using equations (9A) and (9B) to calculate L. To find the new focal points $F_{Qi+1}$ we solve simultaneously equations 7A and 7B with $$r_{2i+1} = [(x_{oFi+1} - x_o)^2 - (y_{oFi+1} - y_{oi+1})^2 - (z_{oFi+1} - z_{oi+1})^2]^{\frac{1}{2}} \tag{19}$$

using the value of $r_{2i+1}$ from (18).

In this manner a new focal point, $F_{Qi+1}$, is found and its coordinate recorded which apportions the ratios squared of $r_1$, $r_2$, and P according to equation (2). Because the normals to surface 3 have been determined and recorded for past points and for the present point, succeeding points can be determined using equations (15A), (15B), and (15C).

For more accurate projections to new positions, (15A) can be replaced by $$z_{oi+1} = z_{oi} + \frac{\Delta x}{24}\left(55 \frac{\partial z_o}{\partial x_o}\bigg|_i - 59 \frac{\partial z_o}{\partial x_o}\bigg|_{i-1} + 37 \frac{\partial z_o}{\partial x_o}\bigg|_{i-2} - 9 \frac{\partial z_o}{\partial x_o}\bigg|_{i-3}\right)$$

and cuts at any desired intervals parallel to the $x_o$ axis or $y_o$ axis on shaped subreflectors, the surface 3 can be made with high accuracy for the offset geometry shown in FIG. 1A and engineering construction is simplified using templets conforming to $x_o z_o$ and $y_o z_o$ curves for cuts through the subreflector surface 3.

This method of constructing the shaped subreflector surface 3 differs fundamentally from prior art procedures in that the point-by-point synthesis permits application to offset geometries without circular symmetry and in that integral equations relating total power radiated by the horn to the power reflected from the subreflector surface are not involved as in earlier procedures such as that published in the IEEE Transactions on Antennas Vol. AP-21, No. 3, May 1973, pages 309 to 313, "Shaping of Subreflectors in Cassegrainian Antennas for Maximum Aperture Efficiency," by G. W. Collins.

We now proceed, referring again to FIG. 2, to find the shape of main reflector surface 1 which will intercept the rays, $\rho$, from the shaped subreflector 3 and reflect these rays in a direction parallel to the z-axis that is along direction indicated by arrow A.

We express $\hat{\rho}=\hat{r}_2$ as lines in the coordinates x, y, z of the reference main reflector 11. By rotation and translation of equations (7A) and (7B) from $x_o$, $y_o$, $z_o$ coordinates to x, y, z coordinates, we obtain:

$$\begin{cases} x = zK_x + \epsilon_x \\ y = zK_y + \epsilon_y \end{cases} \tag{20}$$

where $K_x$ and $K_y$ are slopes of lines representing $\hat{\rho}=\hat{r}_2$ and $\epsilon_x$ and $\epsilon_y$ are the intercepts on the $z=o$ plane for these lines.

This system of rays, $r_2$, passing through known points ($x_o$ $y_o$ $z_o$) on shaped subreflector 3 is obtained and recorded during the iterative synthesis of surface 3 in the procedure just described. This system of rays expressed in equation 20 as lines is sufficient to determine the coordinates of the shaped main reflector surface 1 using the following procedure.

Starting at the central point, $Y_c$, of the reference surface 11 we find the ray $\rho$ expressed as a line by equation (20) which passes through the point $Y_c$. This is done by substituting the coordinates of $Y_c$ which are $x_c=0$ cm, $y_c=-300$ cm, $3_c=-186.67$ cm for the example illustrated into equation (20). The ray $\rho$ passing through $Y_c$ is easily found because both $Y_c$ and $C_1$ lie on reference surfaces whose coordinates can be determined in closed form analytically. In general, it is unlikely that any one of the discreet rays$\rho$ which have been calculated previously will pass through a given point $P_R$(x y z) on the reflector surface 1. However, a very accurate interpolation procedure can be used to find which ray passes through a given point on the surface 1. Referring again to FIG. 2, the general point R with coordinates ($x_R$, $y_R$, $z_R$) can be substituted into the error functions $G_{ix}$ and $G_{jy}$ obtained from equation (20):

$$\begin{cases} G_{xi} = K_{xi}Z_R + \epsilon_{xi} - x_R \\ G_{yj} = K_{yj}Z_R + \epsilon_{yj} - y_R \end{cases} \tag{21}$$

(15A)

When rays $\rho_{i,j}$ represented by 20 by values $K_{xi}$, $E_{xi}$, $K_{yj}$, $E_{yj}$, which pass in the neighborhood of the point R are substituted into 21 the value of $G_{xi}$, and $G_{yj}$ change signs indicating rays have been selected on two sides of the point R. Using interpolation equations $$F_{xi} = \frac{G_{xi}}{(G_{xi} - G_{xi-1})} \tag{22}$$

where i and i−1 are index of rays on different sides of the point R in the X-cut search of the ray population near R we can write with good approximation:

$$K_{xtrue} = K_{xi} - F_{xi}(k_{xi} - k_{xi-1}) \tag{23}$$

and by using analogous equations for y-cut search of the ray population we can obtain $K_x$ true and $K_y$ true.

This information permits the writing of an equation for the direction of the rays $\hat{\rho}$ from surface 3 incident on surface 1 at the point R as $$\vec{\rho}_{true}(X_R, Y_R, Z_R) = \vec{s}_{1\,true} = K_{xt}\hat{X} + K_{yt}\hat{Y} - \hat{Z} \tag{24}$$

and as unit vector $$\hat{s}_{1\,true} = a_{12}\hat{X} + b_{12}\hat{Y} + c_{12}\hat{Z} \tag{25}$$

where $a_{12}$, $b_{12}$, $c_{12}$ are the components of unit vector $s_1$.

To eliminate phase errors on the aperture of 1 we require all rays reflected from surface 1 to be in the direction of arrow A which is the direction $\hat{Z}$. Again using Snell's Law for reflectors in vector form $$\hat{Z} = \hat{s}_1 - 2(\hat{s}_1 \cdot \hat{n}_1)\hat{n} \tag{26}$$

where $\hat{n}_1$ here is the normal to surface 1.

Solving equation (26) for the components of $\hat{n}_1$, that is, $a_{n1}$, $b_{n1}$, $c_{n1}$, we can, using equations (13) and (14), make incremental projections along shaped main reflector 1 along a given cut using, for example, a constant value of $\Delta x$. Then at R+1 point the surface 1 coordinates can be written:

$$Z_{R+1} = Z_{R-1} + 2\Delta x \left.\frac{\partial Z}{\partial x}\right|_R \tag{27A}$$

where $Z_{R-1}$ is the value of Z at a distance $\Delta x$ back along the x-cut. Also:

$$X_{R+1} = X_R + \Delta X \tag{27B}$$

$$Y_{R+1} = Y_R \tag{27C}$$

The resulting shaped main reflector 1 required for receiving and reflecting the rays generated by shaped subreflector 3 when the subreflector is illuminated by a 13.64° flare angle horn 5 having −10dB taper is seen in FIG. 2 to be a surface lying directly in front of the reference surface 11 and tangent to it at the point $Y_c$. The aperture edge locations 39A and 39B are closer together than edge points 40A and 40B resulting in a smaller aperture diameter D than for the reference surface aperture Diameter D'. It is possible, however, to obtain any aperture diameter D for the shaped surface 1 by selecting the parameters f and $Y_c$ for the initial reference surface. The shrinkage of the main reflector 3 compared to the reference reflector 11 allows a shadow free region for locating the second subreflector 15 and feed horn 17, shown in FIG. 1A, such that all rays passing through the focal region surrounding $F_1$ and the variable focal points $F_Q$ and rays received by or radiated from the surface 1 in the direction of arrow A along $\hat{Z}$ will not be blocked by members of feed system 20. This available space for feed system 20 is shown in FIG. 2 between a line connecting 39B and 41B and the z-axis.

Figure 3:
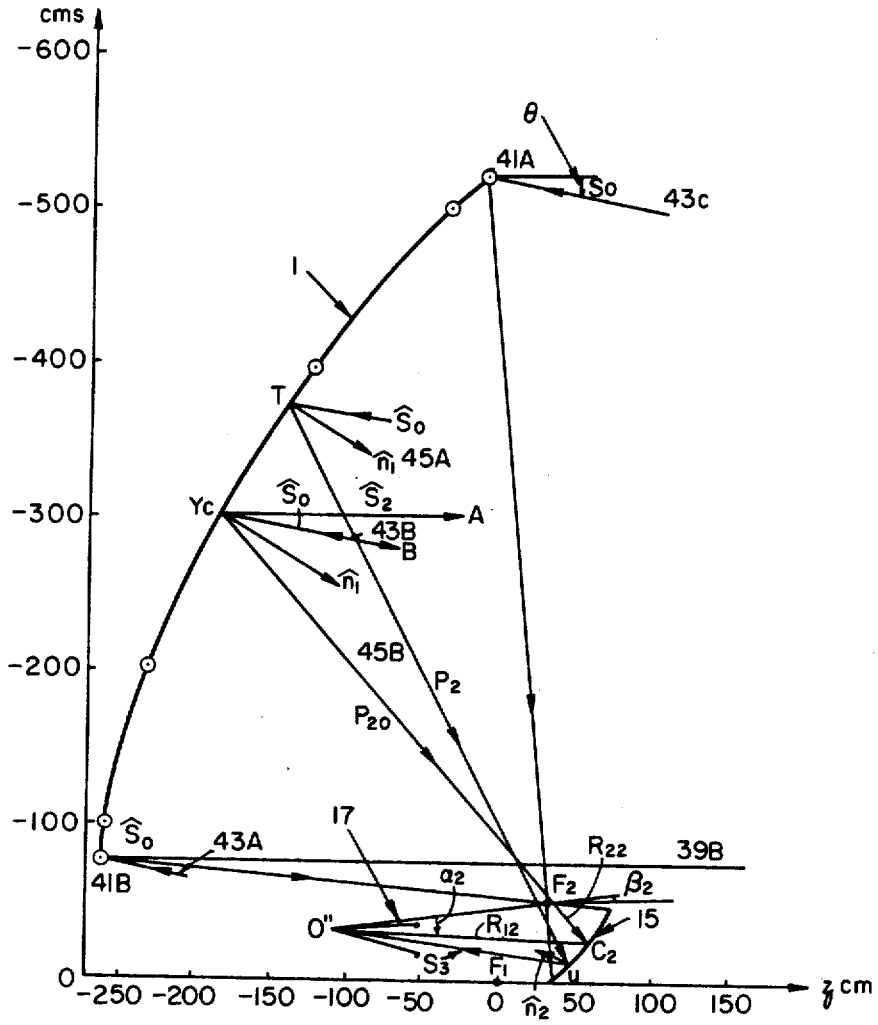
FIG. 3 is a cross-sectional view of the antenna showing again the main shaped reflector with a second horn and shaped subreflector for producing a second antenna beam and antenna pattern.

To determine the shape and location of the second subreflector 15 we first locate the point $F_2$ for best receiving or transmitting a beam in the direction B which, for our example, will be $\theta = 10°$ different than direction A (and lying in the plane of direction A and the z-axis) as shown in FIG. 3. Using the theory of paraboloidal caustics we can relate the aberrations of the reference surface 11 to focal loci according to the book, "Antenna Theory", Vol. II, McGraw Hill 1949, page 61, to establish the coordinates of $F_2$ such that aberrations are minimized for radiation in the direction B. We can position the starting point, $C_2$, on the extension of a straight line. Connecting $Y_c$ and $F_2$, the position of $C_2$ on this line and the position of O'' the center of phase of feed horn 17 is chosen such that the values of $\alpha_2$, $\beta_2$ of FIG. 3 are approximately those of $\alpha$ and $\beta$ of FIG. 2 and such that the initial ratios of rays squared for rays $r_{12} = R_{12}$, $r_{22} = R_{22}$, and $\rho_{20} = \rho_{20}$ passing through O'', $C_2$, $F_2$, and $Y_c$ are approximately the same as for the principal feed system 10 already described, that is $$\text{For the second feed, 20, along central rays connecting points } 0''C_2F_2Y_c \quad \frac{r_{22}^2}{r_{12}^2\rho_{20}^2} \doteq \frac{r_2^2}{r_1^2\rho^2} \quad \text{For principal feed, 10, along central rays connecting points } 0'C_1', F_1', Y_c \tag{28}$$

Because we wish to receive or transmit an antenna beam in the direction of the arrow B of FIG. 1 and FIG. 3, we consider a population of rays $S_o$ from a received plane wave incident from a direction indicated by direction-B representative rays being labelled 43A, 43B, 43C, in FIG. 3. Although, of course, the number of rays needed for accurately constructing subreflector 15 is much greater than 3. Each ray, 43A for example, can be represented by a unit vector $\hat{S}_o$ by equation:

$$\hat{S}_o = -\sin\theta\hat{y} - \cos\theta\hat{z} \tag{29}$$

During the synthesis of the shaped reflecting surface 1 we determined the normals to surface 1 at many points required to construct the main reflector surface 1. These normals, $\hat{n}_1$, which are represented in FIG. 3 by 45A and 45B are known for many points and can be used now to find the directions of rays $\hat{\rho}_2$ which result from the reflection of rays $\hat{S}_o$ from the surface 1 by application of Snell's Law for reflection which is:

$$\hat{\rho}_2 = \hat{S}_o - 2(\hat{S}_o \cdot \hat{n})\hat{n}_1 \tag{30}$$

By solving equation (30) for $\hat{\rho}_2$, we can write these rays as straight line using equation (20) and the information obtained and recorded during the synthesis of reflecting surface 1 giving the direction cosines, $a_{n1}$, $b_{n1}$, $c_{n1}$, at a known location on surface 1 labeled T in FIG. 3. From (30) we write $\rho_2$ as a population of lines along lines $\hat{\rho}_2$ $$\begin{cases} x = zK_{x2} + \epsilon_{x2} \\ y = zK_{y2} + \epsilon_{y2} \end{cases} \tag{31}$$

where $K_{x2}$ is equal to $a_2/c_2$ and $k_{y2}=b_2/c_2$, where $a_2$, $b_2$, and $c_2$ are direction cosines of the ray $\hat{\rho}_2$ and $E_{x2}$ and $E_{y2}$ are intercepts of the line represented by equation (31) on the $z=0$ plane.

Having the rays $\hat{\rho}_2$ as a population of lines by using the synthesis procedure previously used to determine the surface coordinates of surface 1, the coordinates of the shaped subreflector surface 15 can be found for which all rays $\hat{\rho}_2=\hat{r}_{22}$ are reflected from surface 15 such that they are focused to point O''. Beginning at point $C_2$ which has coordinates O, $y_{c2}$, $z_{c2}$ determined by equation (28) again in an iterative stepwise manner we project to a nearby point by, for example, chosing a small increment $\Delta x$. Because the normals about the point, $C_2$, can be estimated accurately we can project using the direction cosines of the normal at points near to $C_2$ to a new position u with coordinates $x_u$, $y_u$, $z_u$, $\Delta x$ from point $C_2$. Arriving at point u the interpolation equations (21), (22), (23), (24) and (25), are used substituting the $K_{x2}$, $K_{y2}$, $E_{x2}$, $E_{y2}$ values from equation (31) in place of the values from 20 used to determine surface 1. Having found the direction cosines of the true ray $\hat{\rho}2$ passing through the point u from this interpolation procedure, it is required that the surface 15 reflect the $\hat{\rho}_2$ true ray to the point focus O'' which is located at the center of phase of conical horn 17 shown in FIG. 1 and also in FIG. 3. Equation (32) gives Snell's Law of reflection for reflecting $\hat{\rho}_2$ true to point O'' as $$\hat{S}_3=\hat{\rho}_{2\,true}-2(\hat{\rho}_{2\,true}\cdot\hat{n}_2)\hat{n}_2 \tag{32A}$$

$$\hat{n}_2=a_{n2}\hat{x}+b_{n2}\hat{y}+c_{n2}\hat{z} \tag{32B}$$

where $$\hat{S}_3=\frac{(x_u-x_{F''})\hat{x}+(y_u-y_{F''})\hat{y}+(z_u-z_{F''})\hat{z}}{[(x_u-x_{F''})^2+(y_u-y_{F''})^2+(z_u-z_{F''})]^{\frac{1}{2}}} \tag{33}$$

and $x''_F$, $y''_F$, $z''_F$ are coordinates of focal point 0'' and $x_u$, $y_u$, $z_u$ are coordinates of the point u on the surface 15.

Using (32) and (33) the normals to surface 15 can be found and extrapolation to the next point on the surface 15 again accomplished by equations (27A), (27B), and (27C) used in determining surface 1, or more precisely by $$z_{y+1}=z_u+\frac{\Delta x}{24}\left(55\frac{\partial z}{\partial x}\bigg|_u-59\frac{\partial z}{\partial x}\bigg|_{u-1}+37\frac{\partial z}{\partial x}\bigg|_{u-2}-9\frac{\partial z}{\partial x}\bigg|_{u-3}\right) \tag{34A}$$

for x cuts on surface 15. Similarly for y cuts on surface 15, equation (34A) becomes $$z_{u+1}=z_u+\frac{\Delta y}{24}\left(55\frac{\partial z}{\partial y}\bigg|_u-59\frac{\partial z}{\partial y}\bigg|_{u-1}+37\frac{\partial z}{\partial y}\bigg|_{u-2}-9\frac{\partial z}{\partial y}\bigg|_{u-3}\right) \tag{34B}$$

where the notation $|_u$, $|_{u-1}$, $|_{u-2}$, $|_{u-3}$ means partial derivative $\partial z/\partial y$ or $\partial z/\partial x$ obtained at earilier points of iterations. Each partial $\partial z/\partial x$, $\partial z/\partial y$ being obtained from the normals $n_2$ by using equation (32B) and again using (13) and (14) where now $$\frac{\partial z}{\partial x}=\frac{-a_{n2}}{c_{n2}}\quad\frac{\partial z}{\partial y}=\frac{-b_{n2}}{c_{n2}}$$

Likewise the x, y coordinates for x cuts are $$x_{u+1}=x_u+\Delta x \tag{34C}$$

$$Y_{u+1}=y_u \tag{34D}$$

and for y cuts:

$$Y_{u+1}=y_u+\Delta y \tag{34E}$$

$$X_{u+1}=x_u \tag{34F}$$

When subreflector 15 is constructed as defined above all rays incident on the main reflecting surface 1 from direction −B are reflected from surface 1 onto subreflector surface 15 from whence they are again reflected to focal point 0''. Point 0'' is the phase center of conical horn 17 which, when radiating electromagnetic energy, will produce a transmitted pattern with main beam in the direction indicated by arrow B. In spite of the shaped, non-conic section form of surface 1 and the aberrations due to an incident or radiated plane wave with normals non-parallel with the axis $\hat{z}$ sharp focusing is achieved at point $\theta''$. Because attention was given in equation (28) to initial values $r_{12}$, $r_{22}$, and 92 $_2$, and as a consequence of the shaping of surface 1, the amplitude taper on the aperture of main reflector 1 will be nearly uniform when illuminated by the second feed system 20 when the pattern taper of horns 5 and 17 are the same and when shaped subreflector 3 was shaped to given uniform aperture illumination for antenna pattern with main beam in the direction A.

To illustrate in more detail the method of antenna construction by numerical examples consider again FIG. 1 wherein the initial values for focal length, f, of the reference offset paraboloidal section is 270 cms, the height of $Y_c$ along the negative y direction is 300 cms and the distance 0'' to $F_1$ is 200 cms.

Figure 4B:
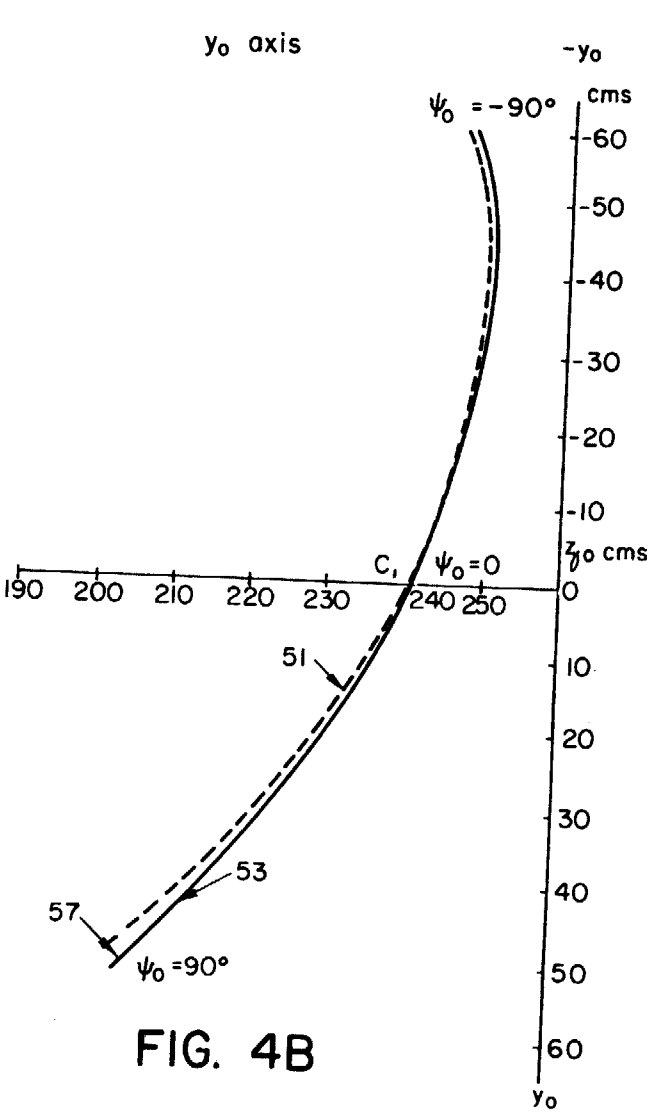
FIG. 4A and FIG. 4B are cross-sectional views through the principal shaped subreflector.
Figure 4A:
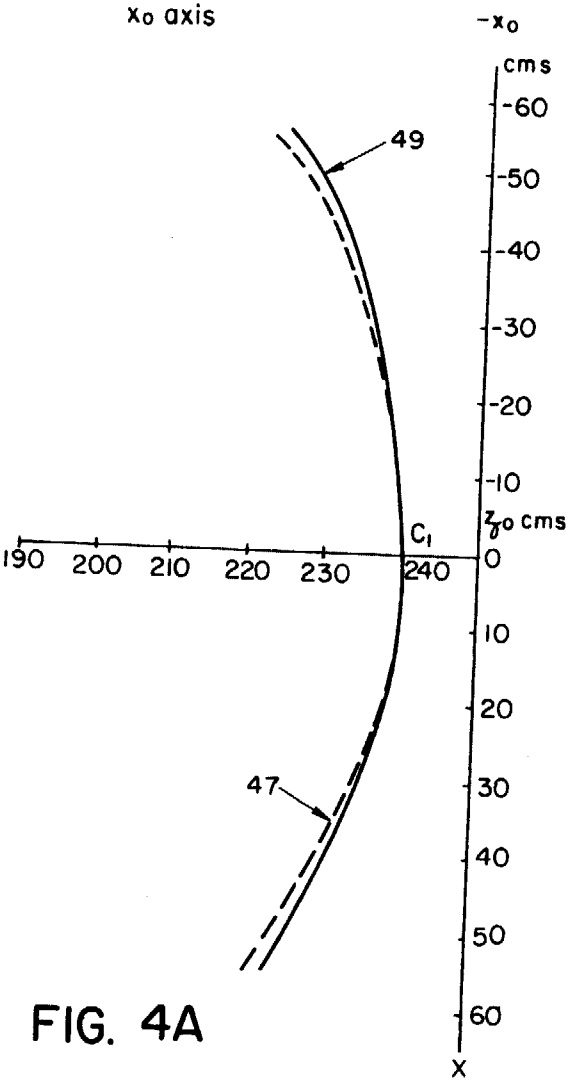

In FIG. 4A curve 47 is a cross-sectional cut along the $x_o$ axis of reference subreflector surface 4. Immediately behind curve 47 and tangent to it, at point $C_1$, is curve 49 which is also a cross-sectional cut along the $x_o$ axis for the shaped subreflector surface 3 when illuminated by horn 5 having a −10 dB taper. Similarly, in FIG. 4B, is shown a cross-sectional curve 51 of the reference surface 4 and curve 53 of the shaped surface 3, both curves being cross-sectional cuts along the $y_o$ axis. Curves 49 and 53 together with like curves determined by the procedures already described are sufficient to construct the entire shaped subreflector surface 3 which, for the example given, produces nearly uniform power density distribution on the surface 1 which distribution radiates a pattern in the direction A with nearly maximum gain for the aperture size of the antenna.

Figure 5:
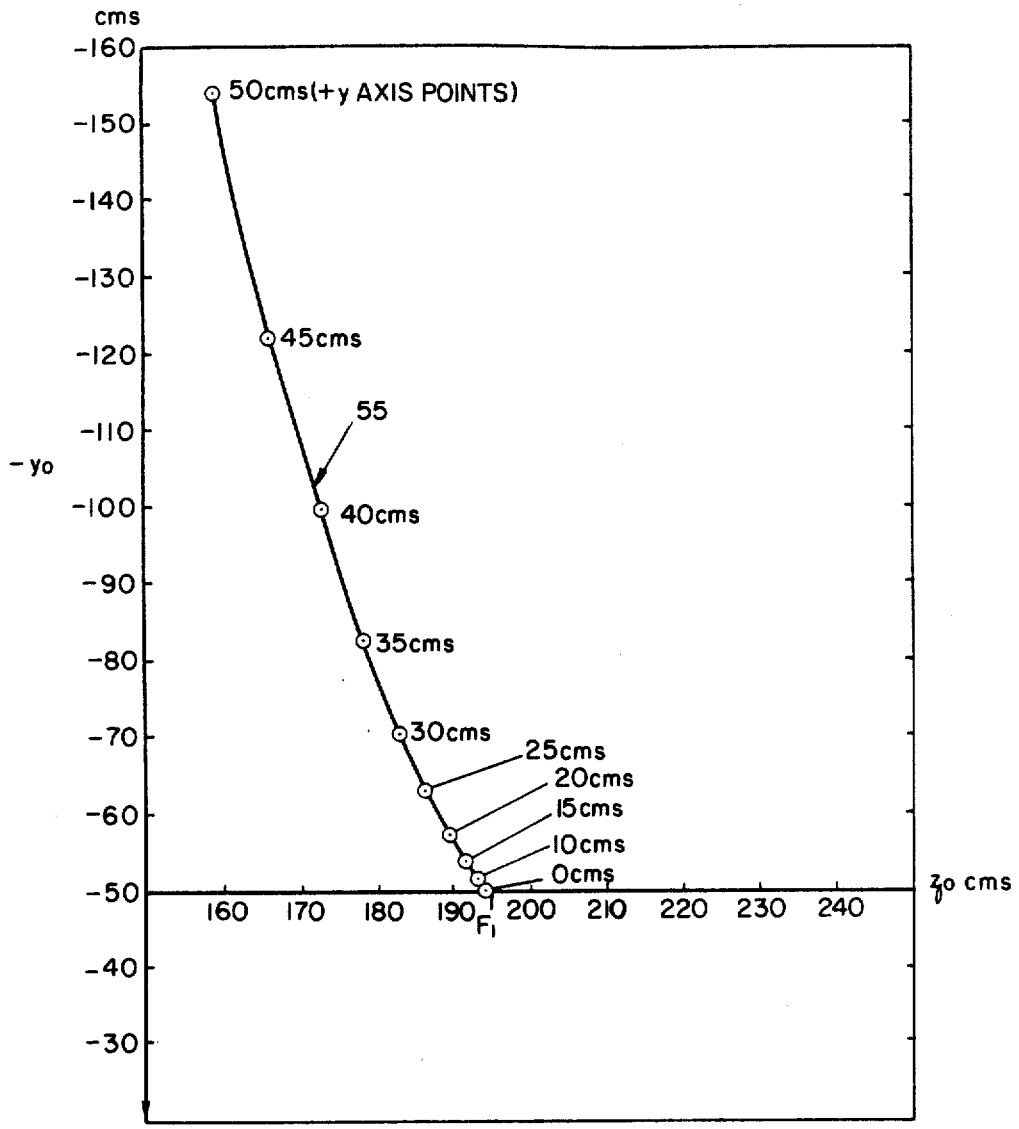
FIG. 5 is a diagram showing the location of focal points of the principal shaped subreflector in the focal region of the main reflector.

To illustrate the varying position of focal points $F_Q$ as characteristic of the ratio squared surface synthesis method, the coordinates $y_o$, $z_o$ for rays $\hat{r}_2$ reflected from the portion of surface 3 or points on the y axis cut curve 53 (shown in FIG. 4B) between the points $C_1$ and edge point 57 are shown in FIG. 5 ds curve 55. Written beside each point is the $y_o$ coordinate of the point of reflection on curve 53 in FIG. 4B where $r_2$ originated.

Figure 6B:
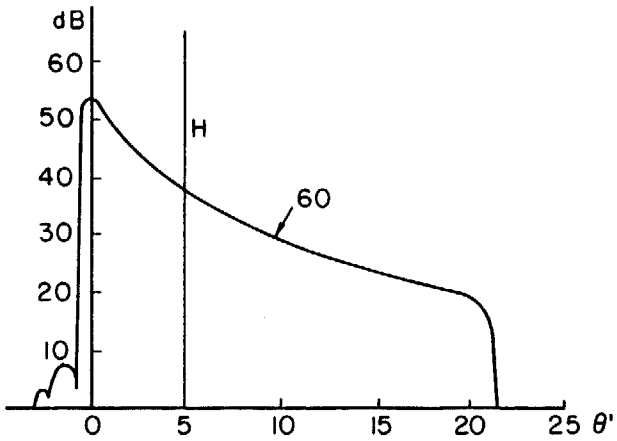
FIG. 6A is a prospective view of a shaped reflector fed by a horn to produce a shaped antenna pattern focused to points as shown in FIG. 6B.
Figure 6A:
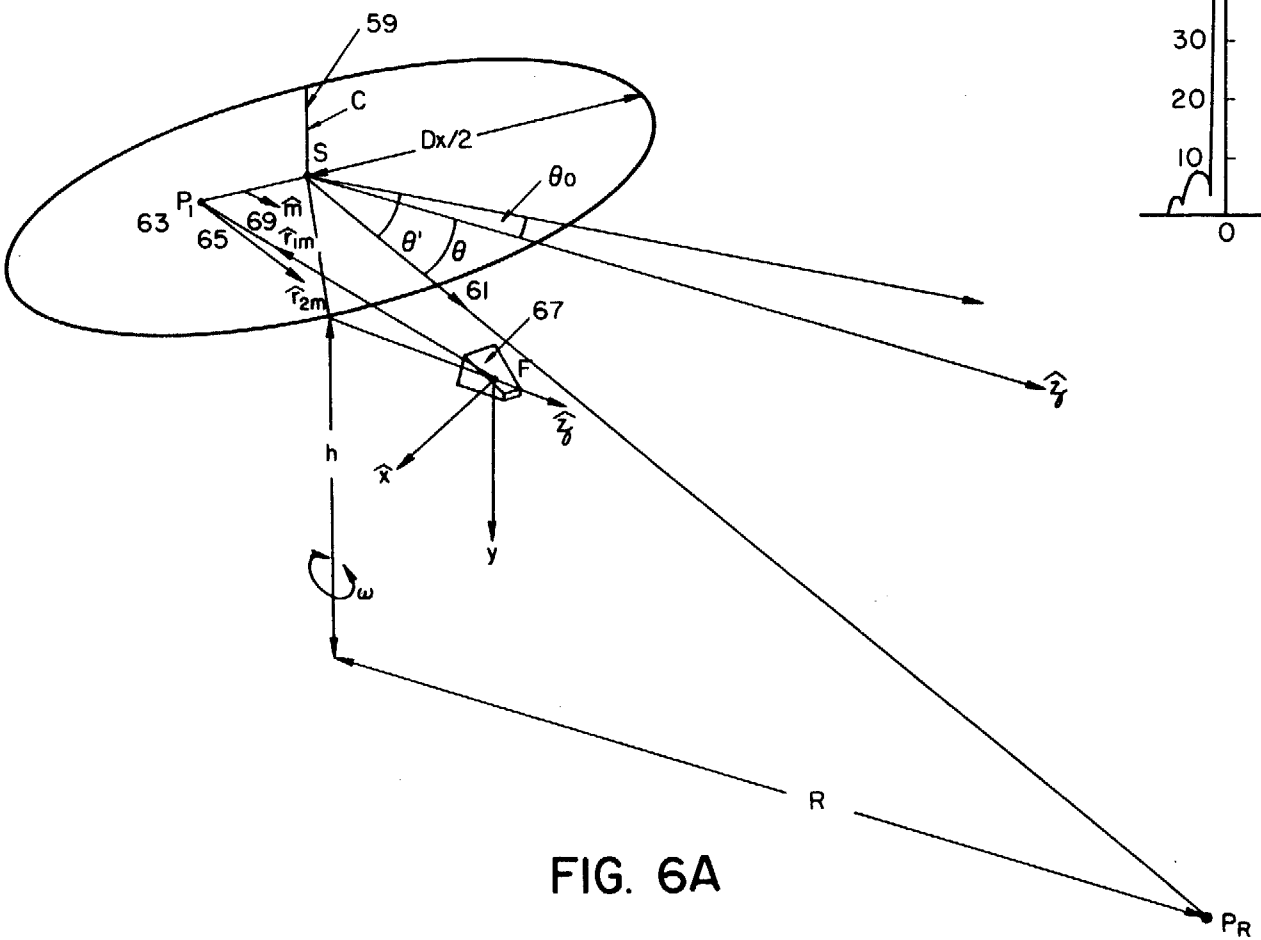

To further illustrate the power and utility of the method for reflector antenna surface synthesis another offset reflector antenna is shown in FIG. 6A. For airport radar surveillance of taxiing and stationary aircraft a coverage pattern 60 in the elevation plane $\theta'$ is required, as shown in FIG. 6B, where $\theta'$ is the depression angle from an elevated antenna at the airport. Azimuth angle determination is made by rotating the antenna in angle $\omega$ indicated by the circular arrow. To increase the azimuth angular resolution of the antenna it is specified that the antenna can focus to points on the runway designated by the elevation angle $\theta$. The usual design procedure is to determine the shape of the central curve 59 by two dimensional shaping methods such that in the yz plane or elevation plane a pattern, similar to 60 shown in FIG. 6B is obtained. Then, by trial and approximation, a series of ellipses in the xz-plane are attached to the curve 59 such that focusing to points $P_R$ along the runway at elevation angles are obtained. Using the method already described herein and having determined the central curve 59 by conventional methods, we have the direction of the reflected ray along arrow 61. Points on the central curve 59 can be used as starting points for x cuts for determining the surface 63 which will direct all reflected vectors $\hat{r}_{2M}$ represented by arrow 65 at a constant value of y to a focus $P_R$ on the runway. This result is attained by writing for the unit vector $\hat{r}_{1M}$ at the phase center of horn as $$\hat{r}_{1M} = \frac{x\hat{x} + y\hat{y} + z\hat{z}}{(x^2 + y^2 + z^2)^{\frac{1}{2}}} \tag{35}$$

$$\hat{r}_{2M} = \frac{(x_P - x)\hat{x} + (y_P - y)\hat{y} + (z_P - z)\hat{z}}{[(x_P - x)^2 + (y_P - y)^2 + (z_P - z)^2]^{\frac{1}{2}}} \tag{36}$$

Where P is located at a range z=R at point x=0, y=R tan $\theta$, z=R.

Again using Snell's Law for reflection $$\hat{r}_{2M} = \hat{r}_{1M} - 2(\hat{r}_{1M} \cdot \hat{n}_M)\hat{n}_M \tag{37}$$

We obtain the normals 69 from which incremental projections using $\partial z/\partial x = -am/cm$ can be made to describe the x-cuts on the surface 63 and a family of such cuts starting at points on curve 59 will describe the entire surface in a systematic and accurate manner. The resulting surface 63 is determined in this manner as a continuous surface accurately determined to focus as designated points $P_R$ on the surface of the earth. The approximations and errors in prior art where eilliptical contours were fitted to a central curve have been eliminated.

Those skilled in the antenna art will recognize or be able to ascertain using no more than routine experimentation, many equivalents to the specified elements described herein. Such equivalents are intended to be covered by the following claims.

What is claimed is:

1. An antenna system for radiating and receiving electromagnetic energy at frequencies above 30 mHz comprising:

two shaped subreflectors being generally separated, non-conic section surfaces and each separately being illuminated and fed by one or more horn radiators and one of the said shaped subreflectors with its illuminating horn radiator or horn radiators being called herein the principal feed and other shaped subreflector with illuminating horn radiator or horn radiators being called herein the secondary feed; and a shaped main reflector being also generally a non-conic section surface mounted in a position fixed with respect to a fixed frame of coordinates referred to the earth's surface and said shaped main reflector being illuminated independently by said principal feed and said secondary feed such that said antenna system produces one or more antenna radiation pattern or patterns each with a main antenna beam pointed in a direction corresponding to the locations and orientations of the main shaped reflector, one of the shaped subreflectors, and one of the horn radiators; and the orientation of said shaped main reflectors with respect to that of the principal feed and the secondary feed being an offset position such that electromagnetic energy radiated to and from the said principal feed and said secondary feed to illuminate said shaped main reflector is largely unobstructed and the electromagnetic energy passing to and from the shaped main reflector surface from signal sources located in directions of said antenna main beams is also largely unobstructed, said orientation of the main shaped subreflector with respect to the principal feed and the secondary feed being referred to a plane of left-right symmetry which divides the shaped main reflector surface and the two shaped subreflector surfaces into nearly equal left-right symmetric portions and such that the center of the shaped subreflector surfaces, the directions of the axes of the several horn radiators and the direction of the antenna main beams all lie approximately in said plane of left-right symmetry, and the orientation of the two shaped subreflectors is such as to position one shaped subreflector above the other and such that the focal region of the main reflector lies between the said two shaped subreflectors and the shaped main reflector; and the shapes of said shaped subreflectors and said shaped main reflector being constructed to produce a prescribed electromagnetic power and phase distribution over the aperture of the shaped main reflector which distribution includes a nearly uniform power and phase aperture distribution when said shaped subreflectors and main reflector are illuminated by said horn radiators and antenna portions are oriented and positioned as specified above to produce said antenna patterns and antenna beams; and said antenna beams being scanned in angular directions by changing the positions of said two subreflectors and their horn radiators with respect to the fixed shaped main reflector position by means of moveable supports and apparatus attached to said two shaped subreflectors and to said horn radiators such that the changed positions of the shaped subreflectors and the horn radiators enable the antenna beams to track angular changes in signal source directions.

2. The antenna system of claim 1 wherein one of said conical horn radiators is attached to one of said shaped subreflectors along portions of the edge of the subreflector and wherein an oval shaped orifice is cut out of the wall of the conical horn radiator to allow unobstructed radiation and reception of electromagnetic energy to proceed through a focal region between said main reflector and said shaped subreflector such said oval orifice being for the purpose of radiating energy to and from the said horn radiator and said subreflector with reduced spillover losses.

3. The antenna system of claim 1 wherein the secondary feed receives and transmits electromagnetic power with radiation patterns having main beams in directions at least one degree in angle remote from directions of the main beams of radiation patterns produced by said principal feed; and said electromagnetic power when received by said shaped main reflector surface is reflected therefrom and impinges on a second shaped subreflector of the secondary feed, herein called the second shaped subreflector, and is reflected therefrom to a point or a small region at which point or small region is located the phase center of a horn radiator, herein called the second horn radiator; and the shape of the surface of the second shaped subreflector and the positions of the second horn radiator and the second shaped subreflector are constructed such that the transmitted radition patterns produced by the secondary feed when electromagnetic power is radiated by said second horn radiator onto the second shaped subreflector which in turn illuminates said shaped main reflector has approximately the same beamwidth for all cross sections measured through its main beam and levels of secondary radiation lobes not appreciably higher than the antenna radiation patterns produced by said principal feed.

4. An antenna system for radiating and receiving electromagnetic energy at frequencies above 30 mHz comprising:

two shaped subreflectors being generally separated, non-conic section surfaces and each separately being illuminated and fed by one or more horn radiators and one of the said shaped subreflectors with its illuminating horn radiator or horn radiators being called herein the principal feed and other shaped subreflector with illuminating horn radiator or horn radiators being called herein the secondary feed; and the principal subreflector is so shaped that electromagnetic power radiated from the said horn radiator is radiated along rays from the phase center of said horn radiator a distance $r_1$ to the interior reflecting surface of said shaped subreflector whereupon it is reflected toward a focal point having a position determined such that the ray path $r_2$ from the said reflector surface to the focal point $F_Q$ and the ray path continuing on from said focal point $F_Q$ to a reference paraboloid surface proximate to the said main reflector a distance $\rho$ such that the squared values of the ray lengths $r_1$ $r_2$ and $\rho$ obey the equation (1)

$$\frac{k_o r_2^2 G(\theta_o, \phi_o)}{r_1^2 \rho^2} = 1 \tag{1}$$

where in equation (1), $k_o$ is a constant and $G(\theta_o, \phi_o)$ represents the power pattern of said horn radiator as a function of $\theta_o$ an angle measured from the axis of said horn radiator and of $\phi_o$ a spherical angle coordinate orthogonal to $\theta_o$ and whereby the shape of said shaped subreflector satisfies equation (1) for successive points projected along the said subreflector surface according to equation (2) which expresses Snell's Law of reflection:

$$\hat{r}_2 = \hat{r}_1 - 2(\hat{r}_1 \cdot \hat{n})\hat{n} \tag{2}$$

wherein $\hat{r}_1$, $\hat{r}_2$, and $\hat{n}$ are unit vectors lying in the direction of rays $r_1$ and $r_2$ and n is directed normal to said subreflector and from the unit vector n, we write $$\hat{n} = a_m n + b_n \hat{y} + c_n \hat{z}$$

wherein $a_n$, $b_n$, and $c_n$ are components of vector $\hat{n}$ in directions of unit vectors $\hat{x}$, $\hat{y}$, $\hat{z}$ which are directed along the axis of the rectangular coordinates used to describe the said shaped subreflector and from the values $a_n$, $b_n$, $c_n$, and by use of equation (3) for the partial derivative $\partial z/\partial x$ and $\partial z/\partial y$ $$\frac{\partial z}{\partial x} = -\frac{a_n}{c_n}; \frac{\partial z}{\partial y} = -\frac{b_n}{c_n} \tag{3}$$

and whereby successive points on said shaped subreflector are located according to the numerical projector equations (4),(5),(6):

$$Z_{i+1} = Z_i + \frac{\Delta x}{24}\left(55 \frac{\partial z}{\partial x}\bigg|_i - 59 \frac{\partial z}{\partial x}\bigg|_{i-1} + 37 \frac{\partial z}{\partial x}\bigg|_{i-2} - 9 \frac{\partial z}{\partial x}\bigg|_{i-3}\right) \tag{4}$$

$$x_{i+1} = x_i + \Delta x \tag{5}$$

$$y_{i+1} = y_i \tag{6}$$

for x cuts across said shaped surface and $$Z_{i+1} = Z_i + \frac{\Delta y}{24}\left(55 \frac{\partial z}{\partial y}\bigg|_i - 59 \frac{\partial z}{\partial y}\bigg|_{i-1} + 37 \frac{\partial z}{\partial y}\bigg|_{i-2} - 9 \frac{\partial z}{\partial y}\bigg|_{i-3}\right) \tag{7}$$

$$y_{i+1} = y_i + \Delta y \tag{8}$$

$$x_{i+1} = x_i \tag{9}$$

for y cuts across said shaped surface and the terms $$\left.\frac{\partial z}{\partial x}\right|_{i-1}, \left.\frac{\partial z}{\partial x}\right|_{i-2}, \left.\frac{\partial z}{\partial x}\right|_{i-3}$$

$$\left.\frac{\partial z}{\partial y}\right|_{i-1}, \left.\frac{\partial z}{\partial y}\right|_{i-2}, \left.\frac{\partial z}{\partial y}\right|_{i-3}$$

are values of the partial derivatives from earlier points obtained for determining the shape of said subreflector surface; and a shaped main reflector being also generally non-conic section surface mounted in a position fixed with respect to a frame of coordinates referred to the earth's surface and said shaped main reflector being illuminated independently by said principal feed and said secondary feed such that said antenna system produces one or more antenna radiation pattern or patterns each with a main antenna beam pointed in a direction corresponding to the locations and orientations of the main shaped reflector, one of the shaped subreflectors, and one of the horn radiators; and the orientation of said shaped main reflector with respect to that of the principal feed and the secondary feed being an offset position such that electromagnetic energy radiated to and from the said principal feed and said secondary feed to illuminate said shaped main reflector is largely unobstructed and the electromagnetic energy passing to and from the shaped main reflector surface from signal sources located in directions of said antenna main beams is also largely unobstructed, said orientation of the main shaped subreflector with respect to the principal feed and the secondary feed being referred to a plane of left-right symmetry which divides the shaped main reflector surface and the two shaped subreflector surfaces into nearly equal left-right symmetric portions and such that the center of the shaped main reflector surface and the centers of the shaped subreflector surfaces, the direction of the antenna main beams all lie approximately in said plane of left-right symmetry, and the orientation of the two shaped subreflectors is such as to position one shaped subreflector above the other and such that the focal region of the main reflector lies between the said two shaped subreflectors and the shaped main reflector; and the shapes of said shaped subreflectors and said shaped main reflector being constructed to produce a prescribed electromagnetic power and phase distribution over the aperture of the shaped main reflector which distribution includes a nearly uniform power and phase aperture distribution when said shaped subreflectors and main reflector are illuminated by said horn radiators and antenna portions are oriented and positioned as specified above to produce said antenna patterns and antenna beams and said antenna beams being scanned in angular directions by changing the positions of said two subreflectors and their horn radiators with respect to the fixed shaped main reflector position by means of moveable supports and apparatus attached to said two shaped subreflectors and to said horn radiators such that the changed positions of the shaped subreflectors and the horn radiators enable the antenna beams to track angular changes in signal source directions.

5. A shaped subreflector surface illuminated by electromagnetic power from a radiator which power, upon reflection from said shaped subreflector surfaces, illuminates a main reflector and said shaped subreflector surface is so shaped that the electromagnetic power radiated from said radiator is radiated along rays from the phase center of said radiator a distance $r_1$ to the interior reflecting surface of said shaped subreflector whereupon it is reflected toward a focal point having a position determined such that the ray path $r_2$ from the said reflector surface to the focal point $F_Q$ and the ray path continuing on from said focal point $F_Q$ to a reference paraboloid surface proximate to the said main reflector a distance $\rho$ such that the squared values of the ray lengths $r_1$, $r_2$, and $\rho$ obey the equation (1)

$$\frac{k_o r_2^2 G(\theta_o, \phi_o)}{r_1^2 \rho^2} = 1 \tag{1}$$

where in equation (1), $k_o$ is a constant and $G(\theta_o, \phi_o)$ represents the power pattern of said radiator as a function of $\theta_o$ an angle measured from the axis of said radiator and of $\phi_o$ a spherical angle coordinate orthogonal to $\theta_o$ and whereby the shape of said shaped subreflector satisfies equation (1) for successive points projected along the said subreflector surface by calculating normal vectors to the said subreflector surface according to equation (2) which expresses Snell's Law of reflection:

$$\hat{r}_2 = \hat{r}_1 - z(\hat{r}_1 \cdot \hat{n})\hat{n} \tag{2}$$

wherein $\hat{r}_1$, $\hat{r}_2$, and $\hat{n}$ are unit vectors lying in the direction of rays $r_1$ and $r_2$ and $\hat{n}$ is directed normal to said subreflector and from the unit vector $\hat{n}$, we write $$\hat{n} = a_n\hat{x} + b_n\hat{y} + c_n\hat{z}$$

wherein $a_n$, $b_n$, and $c_n$ are components of vector n in directions of unit vectors $\hat{x}$, $\hat{y}$, $\hat{z}$ which are directed along the axis of the rectangular coordinates used to describe the said shaped subreflector and from the values $a_n$, $b_n$, $c_n$, and by use of equation (3) for the partial derivative $\partial z/\partial x$ and $\partial z/\partial y$ $$\frac{\partial z}{\partial x} = -\frac{a_n}{c_n}; \frac{\partial z}{\partial y} = -\frac{b_n}{c_n} \tag{3}$$

and whereby successive points on said shaped subreflector are located according to the numerical projector equations (4),(5),(6):

$$Z_{i+1} = Z_i + \frac{\Delta x}{24}\left(55\left.\frac{\partial z}{\partial x}\right|_i - 59\left.\frac{\partial z}{\partial x}\right|_{i-1} + 37\left.\frac{\partial z}{\partial x}\right|_{i-2} - 9\left.\frac{\partial z}{\partial x}\right|_{i-3}\right) \tag{4}$$

$$x_{i+1} = x_i + \Delta x \tag{5}$$

$$y_{i+1} = y_i \tag{6}$$

for x cuts across said shaped surface and $$Z_{i+1} = Z_i + \frac{\Delta y}{24}\left(55\frac{\partial z}{\partial y}\bigg|_i - 59\frac{\partial z}{\partial y}\bigg|_{i-1} + 37\frac{\partial z}{\partial y}\bigg|_{i-2} - 9\frac{\partial z}{\partial y}\bigg|_{i-3}\right) \quad (7)$$

$$y_{i+1} = y_i + \Delta y \quad (8)$$

$$x_{i+1} = x_i \quad (9)$$

for y cuts across said shaped surface and the terms $$\frac{\partial z}{\partial x}\bigg|_{i-1}, \frac{\partial z}{\partial x}\bigg|_{i-2}, \frac{\partial z}{\partial x}\bigg|_{i-3}$$

$$\frac{\partial z}{\partial y}\bigg|_{i-1}, \frac{\partial z}{\partial y}\bigg|_{i-2}, \frac{\partial z}{\partial y}\bigg|_{i-3}$$

are values of the partial derivatives from earlier points obtained for determining the shape of said subreflector surface.

6. A reflector antenna functioning in transmitting and receiving modes comprising:

a shaped reflector and an illuminating feed wherein, the shape of the reflecting surface of the shaped reflector is determined by the radiation pattern of the illuminating feed such that said reflector antenna produces an antenna pattern having a main beam with antenna gain of the approximate form $\csc^2\theta$ in a given plane where $\theta$ is the spherical coordinate angle in said given plane $\theta$ being approximately zero at the peak of said main beam and where $\phi$ is the spherical coordinate angle in planes orthogonal to $\theta$ in which plane said main beam has a narrow nearly constant angular beamwidth such that the said main beam is fan-shaped in form and when $\theta$ is the elevation angle plane measured from the horizon toward the zenith of a radar mounted on the surface of the earth then the radar signals transmitted and subsequently received by said reflector antenna functioning with said radar from a reflecting target flying at a constant altitude above the surface of the earth are nearly constant; and said shaped reflector being a doubly curved surface constructed by connecting points on the reflector surface determined at successive points by finding through interpolation at or near the interception points on the reflecting surface of said rays obtained from the radiation pattern of said illuminating feed and by extrapolation along the reflection surface to successive points by finding normals to and partial derivatives of the reflecting surface under construction through use of said rays and points on the reflecting surface previously determined so that the main beam of the radiation pattern produced by said reflector antenna has the approximate gain function in either the receiving or transmitting mode of $\csc^2\theta$ in the $\theta$ plane and narrow angular beamwidths in said $\theta$ plane orthogonal to the $\theta$ plane and at certain values of the angle $\theta$ the main beam is focused to points at specified distances from the antenna to further reduce the angular beamwidths in $\theta$ planes of the antenna patterns.

7. The reflector antenna of claim 6 wherein said illuminating feed comprises a horn radiator.

8. The reflector antenna of claim 6 wherein said illuminating feed comprises a horn radiator and a shaped subreflector in offset position with respect to the reflector antenna surface such that electromagnetic radiation passing to and from portions of the reflector antenna is unobstructed.

9. An antenna system for radiating and receiving electromagnetic energy comprising:

one or more shaped subreflector or subreflectors, generally not conic sections in form, each illuminated by one or more radiator or radiators; and each radiator together with the subreflector that it illuminates constituting separate antenna feeds, which feeds illuminate a common shaped main reflector whose central portion is tangent to a reference offset paraboloidal section and said main reflector edge contour dimensions are dependent on the radiation pattern of one of the radiators;

and said shaped subreflector or subreflectors and their radiator or radiators are positioned and moved with their central portions lying approximately in a plane containing the central point on the shaped main reflector surface and the axis of said reference offset paraboloidal section such that the electromagnetic energy passing to and from the shaped main reflector and to and from any radiator or shaped subreflector is largely unobstructed;

and the antenna system produces one or more radiation patterns each with a nearly circularly symmetric main beam that can be steered in direction by motions of a radiator and a subreflector;

and the antenna gain and pattern sidelobes of one of the radiation patterns are controlled by shaping the reflecting surface of one of the shaped subreflectors and by shaping the reflecting surface of the shaped main reflector.

10. The antenna systems of claims 1 and 9 wherein the shaped main reflector and one of the shaped subreflectors are approximately conic sections in form, said shaped main reflector having a reflecting surface paraboloidal in form, and said shaped subreflector being a surface of revolution with elliptical or hyperbolic cross section is illuminated by two or more radiators to produce two or more independent antenna patterns with main beams in two or more given directions and with secondary pattern maxima below 15 dB; and wherein the forms of the caustic focal fields in one of the focal regions of the shaped subreflector when illuminated by each of the several horns are of similar form and position to the caustic fields in the region of the caustic fields of said shaped main reflector when the shaped main reflector receives plane waves from said given directions.

11. The antenna system of claim 9 wherein the metal reflecting surface of one of the shaped subreflectors is so shaped that electromagnetic power radiated from the said radiator is radiated along rays from the phase center of said radiator a distance $r_1$ to the interior reflecting surface of said shaped subreflector whereupon it is reflected toward a focal point having a position determined such that the ray path $r_2$ from the said reflector surface of the focal point $F_Q$ and the ray path continuing on from said focal point $F_Q$ to a reference paraboloid surface proximate to the said main reflector a distance $\rho$ such that the squared values of the ray lengths $r_1$, $r_2$ and $\rho$ obey the equation (1)

$$\frac{k_o\, r_2^2 G(\theta_o, \phi_o)}{r_1^2 \rho^2} = 1 \tag{1}$$

where in equation (1), $k_o$ is a constant and $G(\theta_o, \phi_o)$ represents the power pattern of said radiator as a function of $\theta_o$ an angle measured from the axis of said radiator and of $\phi_o$ a spherical angle coordinate orthogonal to $\theta_o$ and whereby the shape of said shaped subreflector satisfied equation (1) for successive points projected along the said subreflector surface by calculating normal vectors to the said subreflector surface according to equation (2) which expresses Snell's Law of reflection:

$$\hat{r}_2 = \hat{r}_1 - 2(\hat{r}_1 \cdot \hat{n})\hat{n} \tag{2}$$

wherein $r_1$, $r_2$, and n are unit vectors lying in the direction of rays $r_1$ and $r_2$ and n is directed normal to said subreflector and from the unit vector n, we write $$\hat{n} = a_n\hat{x} + b_n\hat{y} + c_n\hat{z}$$

wherein $a_n$, $b_n$, and $c_n$ are components of vector $\hat{n}$ in directions of unit vectors $\hat{x}$, $\hat{y}$, $\hat{z}$ which are directed along the axis of the rectangular coordinates used to describe the said shaped subreflector and from the values $a_n$, $b_n$, $c_n$, and by use of equation (3) for the partial derivative $\partial z/\partial x$ and $\partial z/\partial y$ $$\frac{\partial z}{\partial x} = -\frac{a_n}{c_n}\,;\ \frac{\partial z}{\partial y} = -\frac{b_n}{c_n} \tag{3}$$

and whereby successive points on said shaped subreflector are located according to the numerical projector equations (4), (5), (6):

$$Z_{i+1} = Z_i + \frac{\Delta x}{24}\left(55\frac{\partial z}{\partial x}\bigg|_i - 59\frac{\partial z}{\partial x}\bigg|_{i-1} + 37\frac{\partial z}{\partial x}\bigg|_{i-2} - 9\frac{\partial z}{\partial x}\bigg|_{i-3}\right) \tag{4}$$

$$x_{i+1} = X_i + \Delta X \tag{5}$$

$$Y_{i+1} = Y_i \tag{6}$$

for x cuts across said shaped surface and $$Z_{i+1} = Z_i + \frac{\Delta y}{24}\left(55\frac{\partial z}{\partial y}\bigg|_i - 59\frac{\partial z}{\partial y}\bigg|_{i-1} + 37\frac{\partial z}{\partial y}\bigg|_{i-2} - 9\frac{\partial z}{\partial y}\bigg|_{i-3}\right) \tag{7}$$

$$Y_{i+1} = Y_i + \Delta Y \tag{8}$$

$$X_{i+1} = X_i \tag{9}$$

for y cuts across said shaped surface and the terms $$\frac{\partial z}{\partial x}\bigg|_{i-1},\ \frac{\partial z}{\partial x}\bigg|_{i-2},\ \frac{\partial z}{\partial x}\bigg|_{i-3}$$

$$\frac{\partial z}{\partial y}\bigg|_{i-1},\ \frac{\partial z}{\partial y}\bigg|_{i-2},\ \frac{\partial z}{\partial y}\bigg|_{i-3}$$

are values of the partial derivatives from earlier points obtained for determining the shape of said subreflector surface.

12. The antenna systems of claims 1 and 9 wherein said radiator or radiators and said subreflector or subreflectors are each independently positioned and moved with respect to the location and orientation of said main reflector in a manner that independently directs each main beam of said antenna patterns in a given direction, the motion and positioning of each radiator and subreflector being so controlled that the form of the caustic focal fields produced by the subreflector when illuminated the radiator has the same general structure and lies in approximately the same position as the caustic focal fields produced when the main reflector receives a plane wave from said direction of an antenna main beam.

13. The antenna system of claim 9 wherein said shaped main reflector and said shaped subreflectors are positioned and located near to references surfaces; the shaped main reflector having its central portion tangent to a reference surface paraboloidal in form and said subreflectors having central portions tangent to reference surfaces ellipsoidal or hyperboloidal in form, said reference subreflector surfaces being constructed and illuminated by radiators such that the angle $\beta$ measured between the axis of the reference ellipsoid or the reference hyperboloid and the axis of the reference paraboloid satisfy the equation:

$$|Y_c| = \frac{4\,f\,e\sin\beta}{1 + e^2 - 2\,e\cos\beta}$$

where $Y_c$ is the middle point of the reference paraboloidal surface and where e is the eccentricity of the reference ellipsoidal or hydroboloidal subreflector surface and f is the focal length of the reference paraboloidal surface, and the angle $\alpha$ is measured between the axis of the horn radiator and the axis of the ellipsoid or hyperboloid can be found from the equation:

$$\tan\alpha = \frac{(1 + e^2)\sin\beta}{(1 + e^2)\cos\beta - 2e}$$

such that antenna patterns produced by an antenna composed of the reference paraboloidal reflector illuminated by an antenna feed consisting of a reference ellipsoidal or hyperboloidal subreflector and a radiator, whose phase center is located at one foci of the subreflector while the focal point of the reference paraboloidal reflector is located at the other subreflector foci, have circularly symmetric main beams and low cross polarization.

14. The antenna systems of claims 1 and 9 wherein the reflecting surface of said shaped main reflector is so shaped and constructed such that a family of rays, $r_2$, reflected from one of said subreflectors are then incident upon the shaped main reflector and when reflected from the main shaped reflector surface produce another family of rays, $r_3$, which rays are directed approximately parallel to the axis of said reference paraboloidal reflector surface which direction being also in the direction of the main beam of the radiation pattern produced by said radiator illuminating said subreflector which in turn illuminates said shaped main reflector; and said shaped main reflector surface being constructed as determined by ray interpolation among the incident family of rays, $r_2$, at or near a point of incidence on said main reflector surface and by spatial extrapolation from said point using small spatial increments obtained from normal vectors to the said shaped main reflector surface, calculated from Snell's Law of reflection applied to rays obtained by said interpolation of rays, $r_2$, said small spatial increments being connected successively to form reflector contours of the shaped main reflector surface from which contours the entire shaped main reflector surface can be constructed which directs said family of rays, $r_3$, along the direction of said main beam of said radiation pattern which radiation pattern has sidelobes everywhere lower than 17 dB below main beam due to the elimination of aperture phase errors over said shaped main reflector aperture through said shaped construction of the main reflector.

15. The antenna systems of claims 1 and 9 wherein one of the shaped subreflectors is illuminated by two or more radiators to produce two or more independent antenna patterns with main beams in two or more given directions and with secondary pattern maxima below 15 dB; and wherein the forms of the caustic focal fields in one of the focal regions of the shaped subreflector when illuminated by each of the several horns are of similar form and position to the caustic fields in the region of the caustic fields of said shaped main reflector when the shaped main reflector receives plane waves from said given directions.

16. The antenna systems of claims 1 and 9 wherein the aperture illumination distribution is given by f(x,y), where f(x,y) denotes power per unit area, over the aperture of the shaped main reflector with center at x=0 and y=0 the edge contour of the shaped main reflector aperture being approximately circular in form; and one of said shaped subreflectors is constructed such that all ray paths, $r_1$, from the center of phase of a radiator illuminating said shaped subreflector forming a family of rays, $r_1$, which upon being reflected from the shaped subreflector form a family of rays, $r_2$, which are focused to variable focal points or small focal regions $F_Q$ and from thence forming a family of rays $\rho$ which proceed from said variable focal points or small focal regions $F_Q$ to the main shaped reflector surface where the family of rays $\rho$ are reflected again producing the antenna pattern; and wherein all ray path lengths, $r_1$, $r_2$, and $\rho$, obey the equation $$\frac{k_o\, G(\theta_o,\phi_o)\, r_2^2}{r_1^2\, \rho^2} = f(x,y)$$

in which $k_o$ is a constant and $G(\theta_o, \phi_o)$ describes the radiation pattern of said radiator, such that when f(x,y) describes an aperture power distribution over the antenna aperture which have very low power density along and near the edge of the antenna aperture said antenna systems produce an antenna pattern with sidelobe levels everywhere below a level of 30 dB referred to the peak of the antenna main beam.

17. The antenna system of claim 9 wherein said radiation patterns and their main beams are scanned in angular position by motions of the antenna feed or feeds including motions of separate portions of said feed or feeds while keeping the shaped main reflector in a fixed position.

18. The antenna system of claim 9 wherein said antenna patterns and their main beams are scanned in angular position by motions of the entire antenna system including the shaped main reflector while maintaining the antenna feed or feeds in a fixed position with respect to the shaped main reflector.

19. The antenna system of claim 9 wherein said antenna patterns and their main beams are scanned in angular positions by motions of the antenna feeds including the radiators and shaped subreflectors with respect to the location and position of the shaped main reflector which is also moved.

20. The antenna system of claim 9 wherein one of the radiation patterns produced by said antenna system has an antenna gain corresponding to an antenna aperture efficiency of greater than 80% and all secondary maxima are at least 17 dB below the level of the peak of the antenna main beam.

21. The antenna systems of claims 1 and 9 wherein one of said radiators being in the form of an electromagnetic horn is not attached to said shaped subreflector which it illuminates but is constructed by extending its impedance surfaces continuously such that the mouth of the horn radiator nearly touches the shaped subreflector near portions of the edge of said shaped subreflector in order that very little electromagnetic power is lost due to spillover around the edges of the shaped subreflector and allowing very little electromagnetic power to be blocked when passing from the shaped subreflector to the shaped main reflector while, at the same time, providing sufficient space between the horn radiator and the shaped subreflector for these portions of the antenna feed to be independently moved as required for scanning the main beam of antenna pattern produced by the antenna feed.

* * * * *